US007909320B2

(12) United States Patent
Ueda et al.

(10) Patent No.: US 7,909,320 B2
(45) Date of Patent: Mar. 22, 2011

(54) FEEDING APPARATUS, AND IMAGE FORMING APPARATUS INCORPORATING FEEDING APPARATUS

(75) Inventors: Daisuke Ueda, Hachioji (JP); Akira Kosugi, Hachioji (JP); Shigeru Okazaki, Musashimurayama (JP); Takanori Kanda, Hino (JP); Kenichi Hosoi, Kawaguchi (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 66 days.

(21) Appl. No.: 12/222,844

(22) Filed: Aug. 18, 2008

(65) Prior Publication Data

US 2008/0315502 A1 Dec. 25, 2008

Related U.S. Application Data

(62) Division of application No. 11/183,837, filed on Jul. 19, 2005, now Pat. No. 7,429,040.

(30) Foreign Application Priority Data

Nov. 25, 2004 (JP) ..... 2004-340195

(51) Int. Cl.
*B65H 5/00* (2006.01)

(52) U.S. Cl. ..... 271/10.03; 271/122; 271/265.01

(58) Field of Classification Search ..... 271/121–125, 271/10.03, 10.02, 265.01, 265.02
See application file for complete search history.

(56) References Cited

U.S. PATENT DOCUMENTS

| | | | | |
|---|---|---|---|---|
| 5,312,098 | A * | 5/1994 | Inoue | 271/122 |
| 5,599,011 | A * | 2/1997 | Schnorr et al. | 271/10.11 |
| 5,678,123 | A * | 10/1997 | Kim | 399/21 |
| 6,086,062 | A | 7/2000 | Nakamura et al. | |
| 6,338,480 | B1 | 1/2002 | Endo | |
| 6,543,761 | B2 | 4/2003 | Endo | |

FOREIGN PATENT DOCUMENTS

| | | | |
|---|---|---|---|
| JP | 04-313548 | | 11/1992 |
| JP | 09-067037 | | 3/1997 |
| JP | 2000264489 | A * | 9/2000 |
| JP | P2000-264489 | A | 9/2000 |

* cited by examiner

*Primary Examiner* — Stefanos Karmis
*Assistant Examiner* — Michael C McCullough
(74) *Attorney, Agent, or Firm* — Finnegan, Henderson, Farabow, Garrett & Dunner, L.L.P.

(57) ABSTRACT

A feeding apparatus including a feeding roller for conveying a sheet, a separation roller for conveying the sheet in a reverse direction, a transmission mechanism for transmitting the rotational force to the feeding roller, a limited force reverse transmission mechanism for transmitting the rotational force to the separation roller through a torque limiter, a forced reverse transmission mechanism for directly transmitting the rotational force to the separation roller, a temperature detector and a controller, wherein the controller controls the separation roller to receive rotational force through the forced reverse transmission mechanism after the limited force reverse transmission mechanism transmits the rotational force to the separation roller, then allows the limited force reverse transmission mechanism to transmit the rotational force to the separation roller, or to rotate the feeding via the transmission mechanism and the limited force transmission mechanism to transmit the rotational force to the separation roller.

9 Claims, 13 Drawing Sheets

FEEDING APPARATUS, AND IMAGE FORMING APPARATUS INCORPORATING FEEDING APPARATUS

RELATED APPLICATION

This is a divisional of application Ser. No. 11/183,837, filed on Jul. 19, 2005 now U.S. Pat. No. 7,429,040, and claims priority under 35 U.S.C. §119 to Japanese patent Application No. JP2004-340195 filed on Nov. 25, 2004, the contents of both of which are hereby incorporated by reference.

BACKGROUND

The present invention relates to a feeding apparatus for feeding sheets, such as original documents and image recording sheets, which applies to copiers, printers, facsimile machines and multi-functional machines which include the above apparatuses.

DESCRIPTION OF THE RELATED ART

Feeding apparatuses used in the image forming apparatus of a copier, and other image forming apparatuses are generally designed to supply a sheet from a sheet storage device one by one. Accordingly, developed have been technologies for preventing double feed being plural sheets fed at one time when a single paper sheet is intended to be fed.

In typical paper feeding apparatuses incorporating a device to prevent double feeding, a feeding roller structured by a friction roller, such as a rubber surfaced roller, feeds a single sheet of paper. Further the sheet of paper is separated into a single sheet by a driving mechanism having a torque limiter including a separation roller for separating sheets by rotating the separation roller, which is pressed onto the feeding roller, in a reverse direction against the rotational direction of the feeding roller.

Japanese non-examined Patent Publication No. H04-313548 discloses a technology which controls pressure of the separation roller based on occurrence probability of conveyance failure to prevent the double feeding in a friction separation system. Further Japanese non-examined Patent Publication No. H09-67037 discloses a technology which controls the threshold value of the torque limiter for transmitting rotational force to the separation roller based on detected results of friction coefficients between sheets, detected results of separation failures and conveyance rate.

According to the prior art described in the above patent references, the device for preventing double feed device is operated based on the results of detected conveyance failure, etc., and since it is not a device to prevent the double feeding of sheets during conveyance, the double feeding cannot be effectively prevented.

Further, an image forming apparatus, such as a copier, etc., including a feeding apparatus and an image reading apparatus operate under various situations. Accordingly, there is a case that double feeding and non-feeding, which is when no sheet is conveyed, occur based on ambient temperature.

SUMMARY

An object of the present invention is to provide a sheet feeing apparatus, which stably operates without being affected by an ambient temperature change.

An object of the present invention can be attained by a feeding apparatus including a feeding roller for conveying a sheet in a sheet feeding direction, a separation roller for conveying the sheet in a reverse direction against the sheet feeding direction based on rotational force transmitted trough a torque limiter, the separation roller being opposed to the feeding roller, a transmission mechanism for transmitting the rotational force to the feeding roller, a limited force reverse transmission mechanism for transmitting the rotational force to the separation roller through the torque limiter, a forced reverse transmission mechanism for transmitting the rotational force to the separation roller without passing through the torque limiter, a temperature detector for detecting ambient temperature and a controller for selecting a first feeding operation or a second feeding operation based on detected information from the temperature detector, wherein the first feeding operation is to rotate the feeding roller by applying the transmission mechanism and to temporarily rotate the separation roller by applying the forced reverse transmission mechanism after the limited force reverse transmission mechanism transmits the rotational force to the separation roller, then the limited force reverse transmission mechanism transmits the rotational force to the separation roller, and the second feeding operation is to rotate the feeding roller by applying the transmission mechanism and the limited force transmission mechanism transmits the rotational force to the separation roller.

Another object of the present invention can be attained by a feeding apparatus including a feeding roller for conveying a sheet in a sheet feeding direction, a separation roller for conveying the sheet in a reverse direction against the sheet feeding direction based on rotational force transmitted trough a torque limiter, the separation roller being opposed to the feeding roller, a transmission mechanism for transmitting the rotational force to the feeding roller, a first sensor for detecting existence of the sheet, the first sensor being arranged downstream against the feeding roller in a sheet conveyance direction, a temperature detector for detecting ambient temperature, and a controller for controlling a feeding operation based on detected information from the temperature detector, wherein the controller temporarily stops transmitting the rotational force to the separation roller in case the first sensor does not detect the sheet within a first predetermined time interval, which is a time interval from a moment when starting feeding operation or from a reference time set after starting the feeding operation to a moment when the first predetermined time interval has elapsed, and re-transmits the rotational force to the separation roller.

Another object of the present invention can be attained by a feeding apparatus including, a feeding roller for conveying a sheet in a sheet feeding direction, a separation roller for conveying the sheet in a reverse direction against the sheet feeding direction based on rotational force transmitted through a torque limiter, the separation roller being opposed to the feeding roller, a transmission mechanism for transmitting the rotational force to the feeding roller, a limited force reverse transmission mechanism for transmitting the rotational force to the separation roller through the torque limiter, a forced reverse transmission mechanism for transmitting the rotational force to the separation roller without passing through the torque limiter, a temperature detector for detecting ambient temperature, and a controller for selecting a third feeding operation or a fourth feeding operation based on detected information from the temperature detector, wherein the third feeding operation is to rotate the feeding roller by applying the transmission mechanism and to rotate the separation roller by applying the forced reverse transmission mechanism for a fourth predetermined time interval after the limited force reverse transmission mechanism transmits the rotational force to the separation roller, and the fourth feeding operation is to determine whether the leading edge of the sheet reaches to a predetermined place within a first predetermined time interval which is measured from a moment when starting feeding operation or from a reference time set after starting the feeding operation to a moment when the leading edge of the sheet reaches to the predetermined place, after the transmission mechanism rotates the feeding roller and the limited forced reverse transmission mechanism rotates the separation roller, and when the sheet has reached to the predetermined place, the feeding operation is continued, and when the sheet has not reached to the predetermined place, the rotational force is re-transmitted to the separation roller after the transmission of the rotational force to the feeding roller is temporarily stopped, and the separation roller rotates following to the feeding roller.

Another object of the present invention can be attained by a feeding apparatus including a feeding roller for conveying a sheet in a sheet feeding direction, a separation roller for conveying the sheet in a reverse direction against the sheet feeding direction based on rotational force transmitted trough a torque limiter, the separation roller being opposed to the feeding roller, a transmission mechanism for transmitting the rotational force to the feeding roller, a limited force reverse transmission mechanism for transmitting the rotational force to the separation roller through the torque limiter, a forced reverse transmission mechanism for transmitting the rotational force to the separation roller without passing through the torque limiter, a temperature detector for detecting ambient temperature, and a controller for selecting a first feeding operation or a second feeding operation based on detected information from the temperature detector, wherein the first feeding operation is to rotate the feeding roller by applying the transmission mechanism and to temporarily rotate the separation roller by applying the forced reverse transmission mechanism after the limited force reverse transmission mechanism transmits the rotational force to the separation roller, and then the limited force reverse transmission mechanism transfers rotational force to the separation roller, and the second feeding operation is to rotate the feeding roller by applying the transmission mechanism and to transmit the rotational force to the separation roller by applying limited force reverse transmission mechanism.

Another object of the present invention can be attained by an image forming apparatus including a feeding roller for conveying a sheet in a sheet feeding direction, a separation roller for conveying the sheet in a reverse direction against the sheet feeding direction based on rotational force transmitted trough a torque limiter, the separation roller being opposed to the feeding roller, a transmission mechanism for transmitting the rotational force to the feeding roller, a first sensor for detecting existence of the sheet, the first sensor being arranged downstream against the feeding roller in a sheet conveyance direction, a temperature detector for detecting ambient temperature, and a controller for controlling a feeding operation based on detected information from the temperature detector, wherein the controller temporarily stops transmitting the rotational force to the separation roller in case the first sensor does not detect the sheet within a first predetermined time interval being a time interval from a moment when starting feeding operation or from a reference time set after starting the feeding operation to a moment when the first predetermined time interval has elapsed, and re-transmits the rotational force to the separation roller.

Another object of the present invention can be attained by an image forming apparatus including a feeding roller for conveying a sheet in a sheet feeding direction, a separation roller opposed to the feeding roller, the separation roller being arranged to receive rotational force for rotating the separation roller in a reverse direction against the sheet feeding direction through a torque limiter, a transmission mechanism for transmitting the rotational force to the feeding roller, a limited force reverse transmission mechanism for transmitting the rotational force to the separation roller through the torque limiter, a forced reverse transmission mechanism for transmitting the rotational force to the separation roller without passing through the torque limiter, a temperature detector for detecting ambient temperature, and a controller for selecting a third feeding operation or a fourth feeding operation based on detected information from the temperature detector, wherein the third feeding operation is to rotate the feeding roller by applying the transmission mechanism and to rotate the separation roller by applying the forced reverse transmission mechanism for a fourth predetermined time interval after the limited force reverse transmission mechanism transmits the rotational force to the separation roller, and the fourth feeding operation is to rotate the feeding roller by applying the transmission mechanism and to determine whether the leading edge of the sheet reaches to a predetermined place within a first predetermined time interval being a time interval from a moment when starting feeding operation or from a reference time set after starting the feeding operation to a moment when the first predetermined time interval has elapsed, and when the sheet has reached to the predetermined place, the feeding operation is continued, and when the sheet has not reached to the predetermined place, the rotational force is re-transmitted to the separation roller after the transmission of the rotational force to the separation roller is temporarily stopped, and the separation roller rotates following to the feeding roller.

DETAILED DESCRIPTION OF THE PREFERRED EMBODIMENTS

Embodiments of the present invention will be described below. However, the present invention is not limited to the embodiments.

<Image Forming Apparatus>

Figure 1:
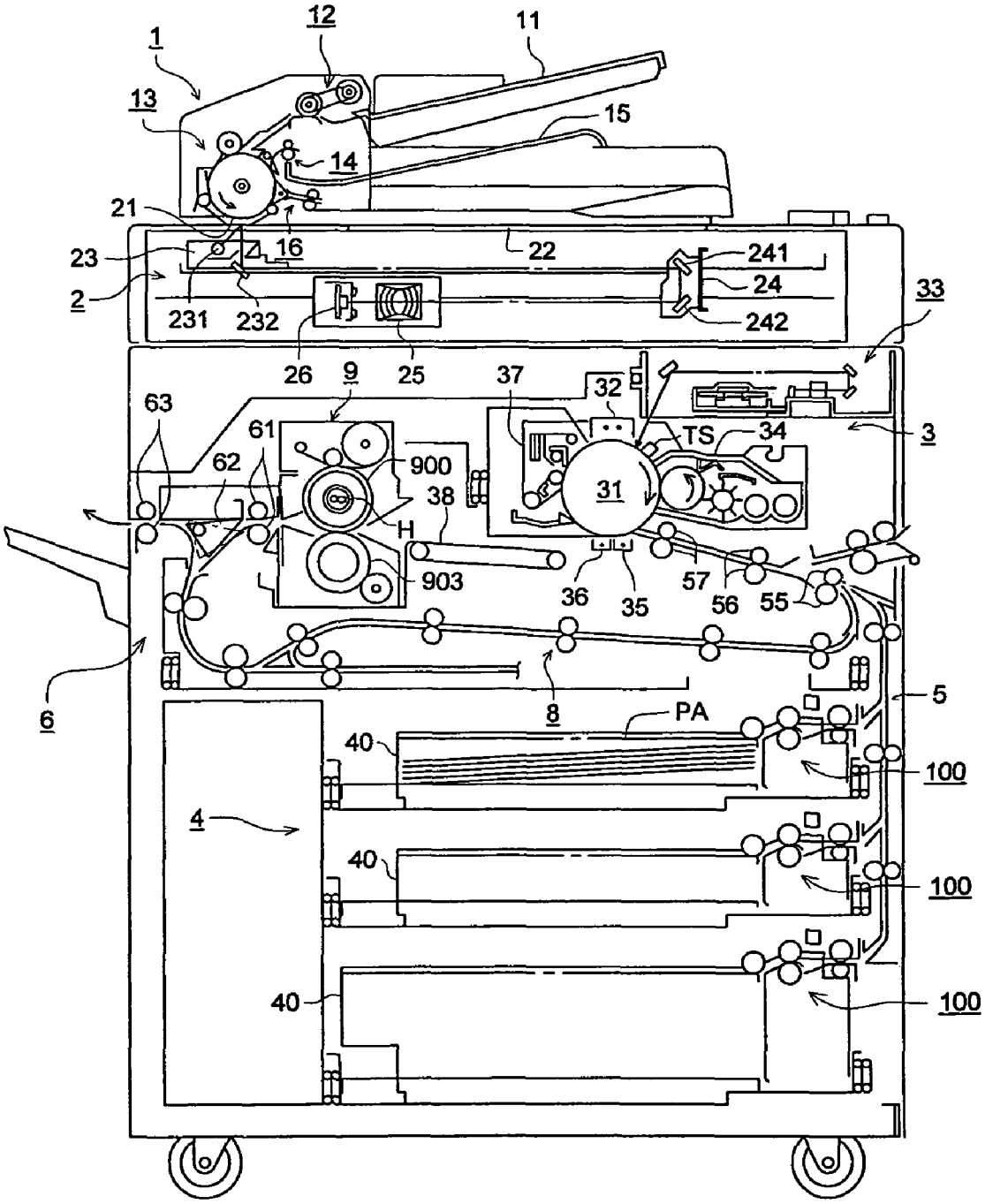
FIG. 1 illustrates an overall view of an image forming apparatus employing the feeding apparatus of the invention.

FIG. 1 illustrates an overall view of an image forming apparatus employing the feeding apparatus of the invention.

Automatic original document feeder 1 comprises original document table 11 for storing original documents, original document separating device 12 for separating original documents placed on original document table 11, original document conveyance device 13 including plural rollers for conveying original documents separated by original document separating device 12, original document ejecting device 14 for ejecting original documents conveyed by original document conveyance device 13, ejected original document table 15 for storing original documents ejected by original document ejecting device 14 and original document flipping device 16 structured by a pared rollers for flipping the front and the back of a double sided original document.

Original document separating device 12 separates plural original documents (not shown) placed on original document placing table 11 into individual original document sheets one by one. After which, original document conveyance device 13 conveys the original document to the image reading section.

The image reading section is provided under original document conveyance device 13. Slit 21 of image reading apparatus 2 formed in the image reading section is designed to read images on the original document.

Automatic original document feeder 1 is structured to pivot upward. Automatic original document feeder 1 is designed to lift automatic original document feeder 1 to clear the area on platen glass 22 so that the original document directly placed can be copied.

Image reading apparatus 2 is an apparatus for obtaining image data by reading images on the original documents. Image reading apparatus 2 comprises first mirror unit 23 structured by lamp 231 for irradiating the original document through slit 21 and first mirror 232 to reflect reflected light from the original document, second mirror unit 24 structured by second mirror 241 for reflecting reflected lights from first mirror 232 and third mirror 242, imaging lens 25 for forming images on a CCD being a solid state image sensor and CCD 26 structured in a line shape to convert an optical image into electric signals.

Analog signals are converted from optical signals to electric signals via CCD 26, which then converted into digital signals (A/D conversion). Then the digital signals are stored in an image memory as image data after image processing is conducted on the digital signals.

In an embodiment of the invention where a original document sent by automatic original document feeder 1 is read by image reading apparatus 2, first mirror unit 23 and second mirror unit 24 are located as shown in FIG. 1.

An original document placed on platen glass 22 is read by moving first mirror unit 23 and second mirror unit 24 while maintaining a constant distance between first mirror unit 23 and second mirror unit 24.

Image forming section 3 comprises photosensitive drum 31 incorporating a photoconductive sensitization layer on its surface serving as an image carrier, charging device 32 including a charging electrode for uniformly charging the surface of photosensitive drum 31, writing device 33, being an exposing device for forming an electrically static latent image (it is also simply called a latent image) by exposing the surface of photosensitive drum 31 based on image data after completing the image processing, developing apparatus 34 forming a toner image by reversibly developing the latent image formed on photosensitive drum 31, transferring device 35 for transferring the toner image onto a normal paper sheet being a normal paper sheet (which will simply be call a sheet hereinafter), separating device 36 for separating the sheet from photosensitive drum 31 by conducting corona discharge based on AC voltage (alternate current) or DC voltage onto which AC is superimposed, onto a back side surface of the sheet onto which toner images are transferred and cleaning device 37 which cleans photosensitive drum 31 after completing a transferring process.

Ejecting roller 38 is a roller for conveying the paper sheet after separation to a fixing apparatus, for example fixing apparatus 9 featuring a heating roller and ejecting roller 38 is a roller for ejecting a paper sheet.

Fixing apparatus 9 collectively comprises heating source H, upper fixing roller 900 and lower fixing roller 903 which rotates while contacting with upper roller 900 as main components, and switching device 62, which changes the paper conveyance route.

The image forming process described above is performed via the following steps including, forming a latent image corresponding to the original document image via dot exposure by writing device 33 after charging photosensitive drum 331 via charging device 32, then, developing the latent image into a toner image via developing apparatus 34. After that, transferring device 35 transfers the toner image onto a paper sheet fed via registration roller 56 as a second feeding device when registration roller 56 starts rotating.

Practically, the process to start development of the toner image on photosensitive drum 31 is arranged to synchronize with the timing of paper feeding operation associated with the rotation start of registration roller 56 under the condition that the paper sheet has reached to registration roller 56.

Accordingly, the distance from the writing position on photosensitive drum 31 via writing device 33 is designed to be equal to the distance from the registration roller 56 to transferring device 35 and the linear velocity of photosensitive drum 31, registration roller 56 and pre-transferring roller 57 are set to be equal.

The paper sheet on to which the toner images have been transferred is separated from photosensitive drum 31 by the action of separating device 36 and ejected out of the apparatus after completion of heating-and-pressing action of fixing apparatus 9.

Photosensitive drum 31 continues rotating after passing through a transfer area and preparing for the next image formation after cleaning device 37 removes any residual toner remaining on photosensitive drum 31.

Continuing of the description of the structure of the image forming apparatus, three separate sheet-feeding trays 40 for storing sheets PA provided in a vertically stacked state are arranged in paper storing section 4, and each sheet-feeding tray 40 is designed to be easily removed.

Each sheet-feeding tray 40 includes feeding apparatus 100, which feeds sheet PA, and sheet conveyer 5 conveys sheet PA to image forming section 3. Feeding apparatus 100 will be described later.

Paired conveyance rollers 55 are located at the junction of paper-feeding section 5 and reverse conveyance section 8.

Reverse ejection/re-feeder 6 functions to turn over sheet PA after completing of the transferring and fixing processes and re-feeds sheet PA based on the double sided image forming mode. Reversing conveyance section 8 has a function to turn over the sheet PA fed into reversing ejection-and-refeeding section 6 and to covey to paired registration rollers 56. However, since these are not directly related to the invention, detailed description will be omitted.

Temperature sensor TS is a sensor serving as a temperature detecting device for detecting temperature of an inside of an image forming apparatus. In the example shown in FIG. 1, temperature sensor TS is provided to detect the surface temperature of photosensitive drum 31 in a position adjacent to an exposing section.

Embodiment 1

Figure 2:
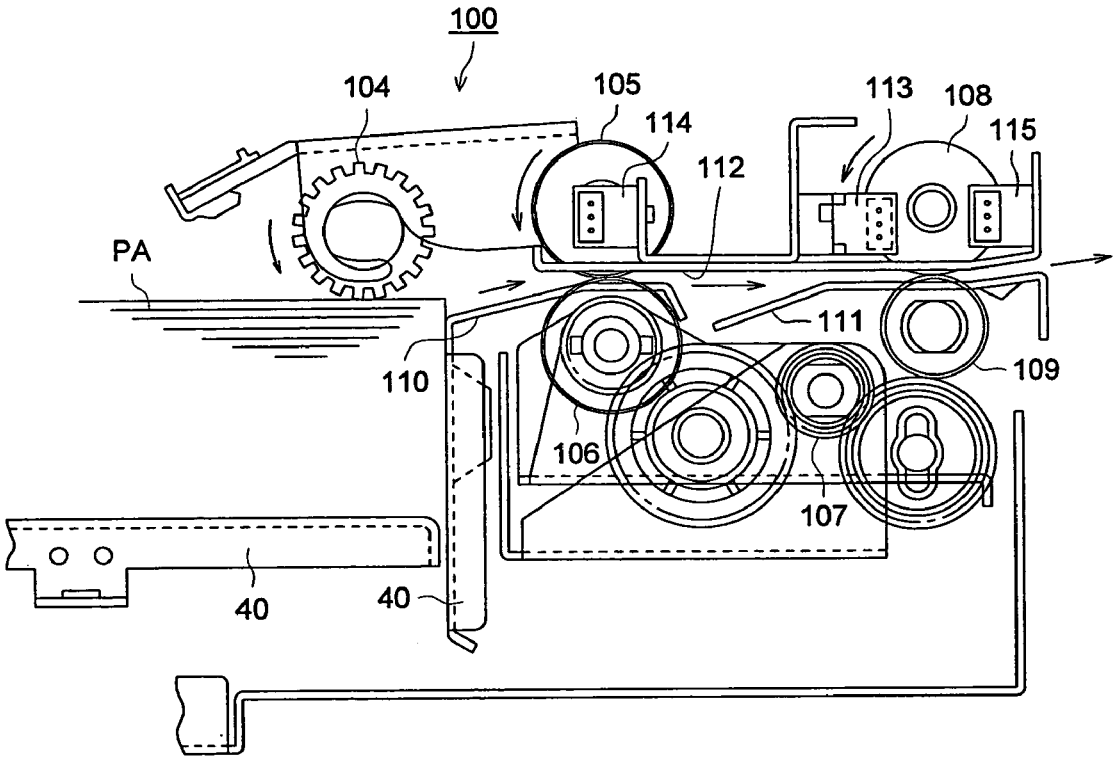
FIG. 2 illustrates a side view of embodiments 1, 2 and 4.

Embodiment 1 will now be described by referring to FIGS. 2-5. FIG. 2 is a side view of feeding apparatus 100.

As shown in FIG. 2, a feeding apparatus 100 is arranged adjacent to a sheet-feeding tray 40 capable of storing a large number of sheets of sheet PA stacked horizontally in the sheet-feeding tray 40. A sheet feeding roller 104 for feeding sheet PA into the feeding apparatus 100 is arranged over the sheet-feeding tray 40. The sheet feeding roller 104 is in contact with sheet PA on the top sheet-feeding tray 40 due to the own weight. The sheet feeding roller 104 is arranged to rotate in a counterclockwise and to basically feed a single sheet PA on the sheet-feeding tray 40 by rotating while being in contact with the sheet placed on the top of the sheet-feeding tray 40 into the feeding apparatus 100 one by one.

A sheet feeing roller 105 for conveying sheet PA sent by the sheet feeding roller 104 to the next process is provided downstream of the sheet feeding roller 104, in the conveyance direction of sheet PA. A separation roller 106 for separating a sheet from sheets PA located in a lower portion of plural sheets PA when they are fed in an overlapped state. The sheet feeding roller 105 is in contact with the separation roller 106 on their outer periphery. The sheet feeding roller 105 is arranged to rotate in a counterclockwise, the same as the sheet feeding roller 104 as shown in FIG. 2 and to convey sheets PA fed by the sheet feeding roller 104 from the left side to the right end in FIG. 2.

The separation roller 106 in FIG. 2 is arranged to have rotational force to rotate counterclockwise to covey sheets PA by the sheet feeding roller 105 in the reverse direction of the feeding direction. In FIG. 2, a torque limiter 107 for limiting rotational force to be transmitted to the separation roller 106 is provided on the right end of the separation roller 106. Accordingly, the separation roller 106 constantly rotates in a counterclockwise with limited rotational force. Further, with regard to the sheet feeding roller 105 and the separation roller 106, the diameter of the sheet feeding roller 105 is arranged to be relatively larger than that of the separation roller 106. The outer periphery of the sheet feeding roller 105 is structured by a material whereby the friction coefficient of the outer periphery of the feeding roller 105 against sheet PA is greater than the friction coefficient of outer periphery of the separation roller 106 against sheet PA. The tolerance for frictional wear can be broadened by setting the diameter of the sheet feeding roller 105 larger than that of the separation roller 106. It therefore becomes possible to securely feed a sheet while preventing superposition of other sheets by setting the friction coefficient against sheets PA of the sheet feeding roller 105 to be greater than that of the separation roller 106. Rubber structures the outer peripheries of both sheet feeding roller 105 and separation roller 106. As an example, the outer periphery of the sheet feeding roller 105 can be structured by ethylene-propylene rubber (EPM, EPDM), while the outer periphery of the separation roller 106 can be structured by urethane rubber. However it is possible that the same kind of rubber or different types of rubber as described above may structure the sheet feeding roller 105 and the separation roller 106. It is preferable that the rubber applied for the outer periphery of the separation roller 106 is harder than that of the sheet feeding roller 105. The frictional wear can be suppressed by applying a harder rubber on the outer periphery of the separation roller 106 than that of the sheet feeding roller 105.

A conveyance roller 108 for conveying sheets PA conveyed by the sheet feeding roller 105 to the next process, and a following roller 109 rotating following to the rotation of the conveyance roller 108 are provided downstream of the sheet feeding roller 105 and the separation roller 106 located in the conveyance direction of sheet PA. The conveyance roller 108 and the following roller 109 are in contacted at the outer peripheries of both rollers. The conveyance roller 108 is arranged to rotate in counterclockwise, being same rotational direction of the abovementioned sheet feeding roller 105 as shown in FIG. 2. The conveyance roller 108 and the following roller 109 are arranged to covey sheets PA from the conveyance roller 105 from left to right as shown in FIG. 2. The following roller 109 is arranged to freely rotate clockwise following to the rotation of the conveyance roller 108 as shown in FIG. 2.

Three guide plates 110, 111 and 112 for guiding sheets PA from left to right in FIG. 2 are provided along the conveyance path of sheets PA. Each guide plate 110, 111 or 112 is extended from the front to the rear (or from the rear to the front) of FIG. 2. A guide plate 110 enables a conveyance of sheets PA from the sheet tray 40 to the separation roller 106, the guide plate 111 enables the conveyance path from the separation roller 106 downstream of the following roller 109 and the guide plate 112 enables the conveyance path from the above the mid-point of the guide plate 110 to end of the guide plate 111. According to the embodiment, sheets PA are arranged to be conveyed from the sheet-feeding tray 40 to the outside of the feeding apparatus 100 via the sheet feeding roller 105, the separation roller 106, the conveyance roller 108 and the following roller 109 while sheets PA are guided by the guide plates 110, 111 and 112.

Further, three sensors 113, 114 and 115 are provided along the conveyance path of sheets PA. A first sensor 113 is provided adjacent to the conveyance roller 108 and in upstream of the conveyance roller 108 in the conveyance direction of sheets PA. A second sensor 114 is provided adjacent to the conveyance roller 105 and upstream of the first sensor 113 in a conveyance direction of sheets PA. A third sensor 115 is provided adjacent to the conveyance roller 108 and downstream of the conveyance roller 108 in the conveyance direction of sheets PA. Particularly, the second sensor 114 is arranged so that the minimum distance between the second sensor 114 to the conveyance path is equal to or less than the radius of the sheet feeding roller 105, so as to instantly detect the presence of a sheet passing the contacting area of the sheet feeding roller 105 and the separation roller 106.

The configuration of a driving system of feeding apparatus 100 will be described by referring to FIG. 3.

Figure 3:
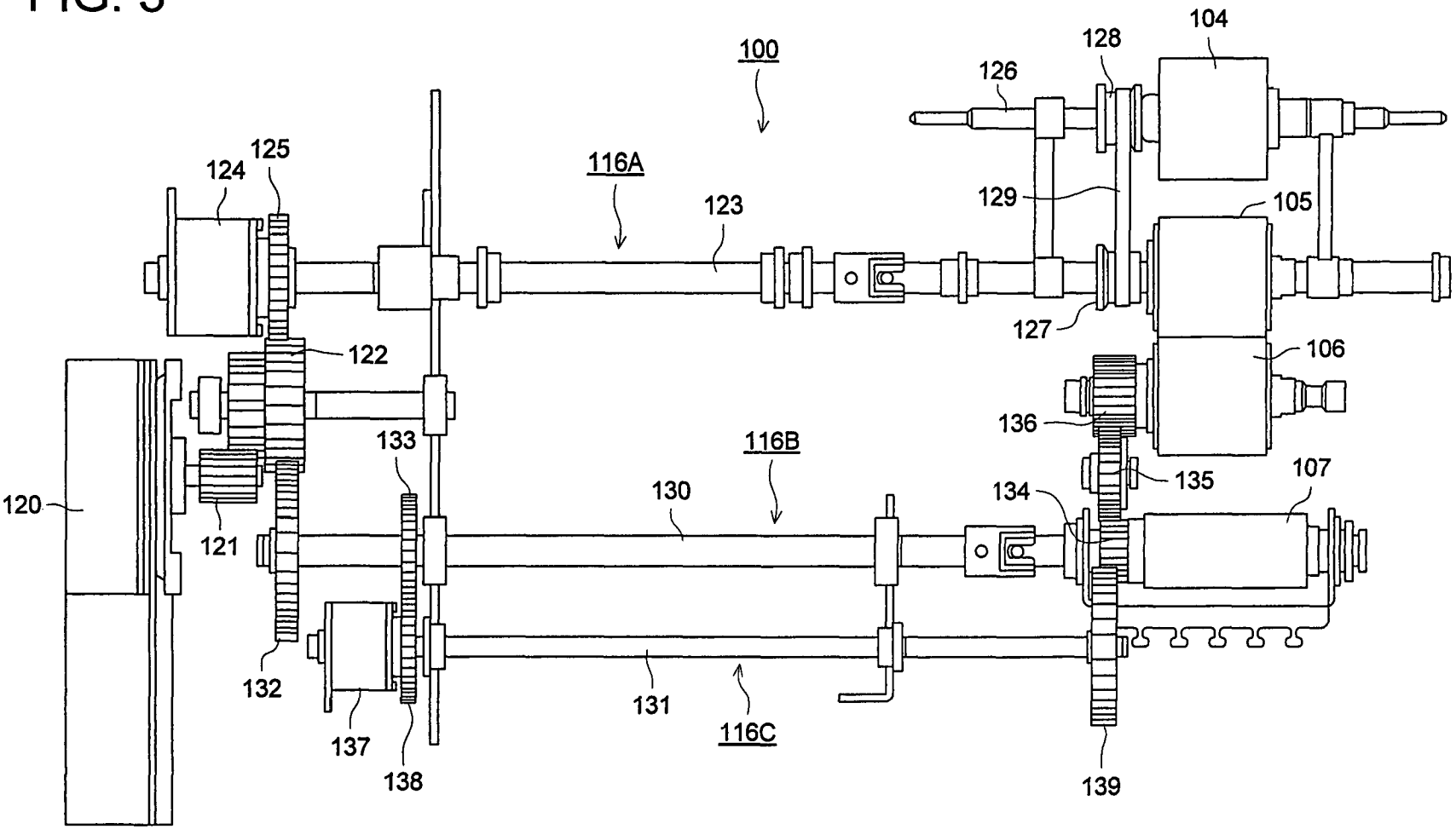
FIG. 3 illustrates a front view of embodiment 1 of the invention.

FIG. 3 illustrates a front view of the feeding apparatus 100.

The feeding apparatus 100 includes a motor 120 as a driving source of the sheet feeding roller 104, the sheet feeding roller 105 and the separation roller 106. A gear 121 is fixed on the output shaft of the motor 120. The gear 121 is geared to a transmission gear 122, which transmits rotational force of the motor 120 to all rollers, such as, the sheet feeding roller 104, the sheet feeding roller 105 and the separation roller 106. The feeding apparatus 100 includes a transmission mechanism 116A for feeding sheets PA from the sheet tray 40 by transmitting rotational force of the motor 120 from the gear 122 to the sheet feeding roller 104 and the sheet feeding roller 105, and the feeding transmission mechanism 116B for returning sheets PA to the sheet tray 40 by transmitting rotational force of the motor 120 from the transmission gear 122 to the separation roller 106.

The transmission mechanism 116A comprises a shaft 123 which can freely rotate. An electro-magnetic clutch 124 is provided at the left edge of the shaft 123 in FIG. 3, and the electro-magnetic clutch 124 switches whether transmitting the rotational force of the motor 120 to the sheet feeding roller 104 and the sheet feeding roller 105 or not. A clutch gear 125 of the electro-magnetic clutch 124 engages the transmission gear 122. The shaft 123 and a rotational shaft 126 of the sheet feeding roller 104 respectively have pulleys 127 and 128, each of which is fixed on to the respective shafts. Endless belt 129 is entertained around respective pulleys 127 and 128.

In the transmission mechanism 116A, when the electro-magnetic clutch 124 is engaged, while the motor 120 is in rotation operation, and since the shaft 123 and the electro-magnetic clutch 124 are geared to transmit rotational force of the motor 120 to the shaft 123 via the transmission gear 122 and the clutch gear 125, the shaft 123 rotates. While the shaft 123 rotates, the sheet feeding roller 105 rotates and the rotational force is, transmitted to the rotational shaft 126 via the belt 129. Accordingly, the sheet feeding roller 104 and the sheet feeding roller 105 simultaneously rotate in the same direction.

On the other hand, when the motor 120 is in operation and the electro-magnetic clutch 124 is turned off to stop operation, the connection between the shaft 123 and the electro-magnetic clutch 124 is released and the clutch gear 125 freewheels. As a result, the rotation of shaft 123 comes to stop. At this time, since rotational force of the transmission gear 122 to the shaft 123 is turned off, the sheet feeding roller 104 and the sheet feeding roller 105 also simultaneously stops. Namely, in the transmission mechanism 116A, the sheet feeding roller 104 synchronizes with the sheet feeding roller 105 to conduct operation based on the engagement or disengagement of the electro-magnetic clutch 124.

Shafts 130 and 131 capable of rotating around the center axis of each shaft are provided in a limited reverse transmission mechanism 116B and a forced reverse transmission mechanism 116C. Gears 132 and 133 having different diameters, at a predetermined interval between them, are provided at the left end of shaft 130 as shown in FIG. 3. The Gear 132 has a larger diameter than that of the gear 133 and engages the transmission gear 122. A torque limiter 107 is provided on the right end of the shaft 130 in FIG. 3. A gear 134 is provided on the left end of the torque limiter 107 and engages a gear 135. A gear 136 is provided on the rotational shaft of the separation roller 106 and the gear 136 engages the gear 135.

In the limited reverse transmission mechanism 116B including the shaft 130, rotational force of the motor 120 is transmitted to the shaft 130 via the gears 122 and 132 to rotate the shaft 130. Once the shaft 130 rotates, the rotational force is transmitted to the separation roller 106 under condition limited by the torque limiter 107 via the gears 134, 135 and 136. The separation roller 106 is arranged to rotate in a reverse direction to the paper feeding direction set by the sheet feeding roller 104 and the sheet feeding roller 105. Namely, since the torque limiter is provided between the shaft 130 and the separation roller 106 in the limited reverse transmission mechanism 116B which uses the shaft 130, the full rotational force of the motor 120 is not transmitted to the separation roller 106 and thereby limited but constant rotational force is transmitted from the motor 120 to the separation roller 106.

In the forced reverse transmission mechanism 116*c*, an electro-magnetic clutch 137 functions as being a forced reverse transmission electro-magnetic clutch to switch the selection whether forcefully transmit rotational force of the motor 120 to the separation roller. The clutch gear 138 of the electro-magnetic clutch 137 engages gear 133. In FIG. 3, a gear 139 is provided on the right end of the shaft 131 and the gear 139 engages the gear 134 of the torque limiter 107.

In the forced reverse transmission mechanism 116C applying the shaft 131, when the electro-magnetic clutch 137 is turned on, while the motor 120 is in rotation operation, since the shaft 131 and the electro-magnetic clutch 137 are connected, rotational force of the motor 120 is transmitted to the shaft 131 via the transmission gears 132, 133 and the clutch gear 138, whereby the shaft 131 rotates. Once the shaft 131 rotates, rotational force is transmitted to the separation roller 106 via gears 134, 135 and 136. The separation roller 106 rotates so that the separation roller 106 conveys sheets PA to a reverse direction against paper feed direction by the sheet feeding roller 104 and the sheet feeding roller 105.

On the contrary, the electro-magnetic clutch 137 is turned off to stop operation of the electro-magnetic clutch 137 while the motor 120 is in non-operation, and the connection between the shaft 131 and the electro-magnetic clutch 137 comes to release. As a result, the clutch gear 138 freewheels and rotational force from the shaft 131 to the separation roller 106 is intercepted.

In the abovementioned limited reverse transmission mechanism 116B, rotational force of the motor 120 is transmitted to the separation roller 106 via the torque limiter 107. In the abovementioned forced reverse transmission mechanism 116C, rotational force of the motor 120 is transmitted to the separation roller 106 without via the torque limiter 107.

Further, even though it is not shown in FIGS. 2 and 3, the feeding apparatus 100, separately includes members, such as the shaft, the gear and an electro-magnetic clutch 141 (please refer to FIG. 4) for transmitting rotational force of the motor 120 to the sheet feeding roller 104, the sheet feeding roller 105 and the separation roller 106, the same as the abovementioned sheet feeding mechanism 116A. The conveyance roller 108 is arranged to freewheel based on an operation of the electro-magnetic clutch 141.

A circuit configuration of the feeding apparatus 100 will be described by referring to FIG. 4.

Figure 4:
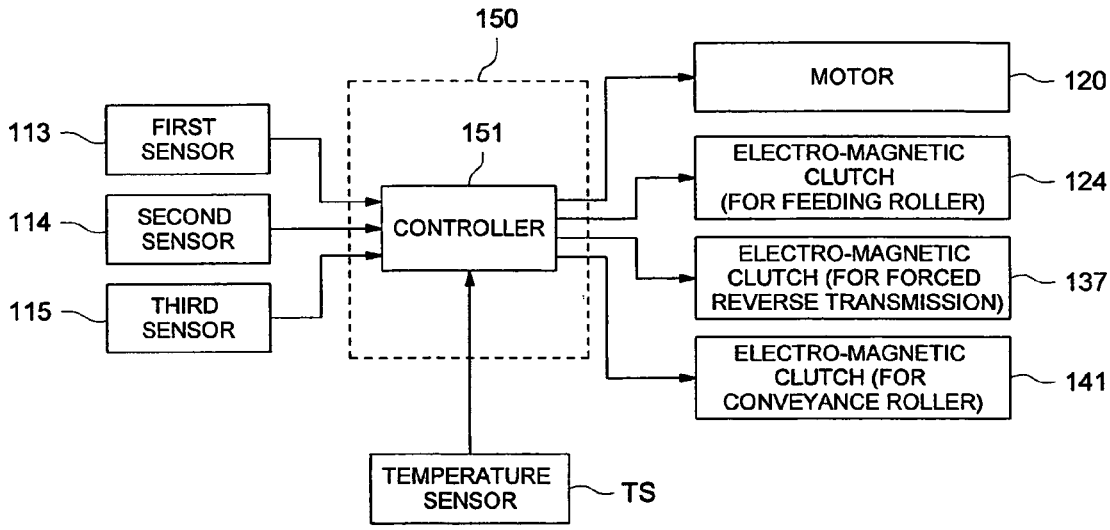
FIG. 4 illustrates a block diagram of embodiment 1 showing the circuit configuration of the feeding apparatus of the invention.

FIG. 4 is a block diagram showing circuit configuration of the feeding apparatus 100.

A controlling device 150 includes a controller 151 configured by a general-purpose CPU (Central Processing Unit), a ROM (Read Only Memory), a RAM (Random Access Memory) and a circuit, such as a non-volatile memory (not shown). The controller 151 is designed to transfer a processing-program from the ROM to the RAM whereby the CPU executes the processing program.

Concretely, the controller 151 is arranged to control the motor 120 and respective components connected to the electro-magnetic clutches 124, 137 and 141 based on the processing program. Particularly, in the feeding apparatus 100, the sensors 113-115 are connected to the controller 151 which is arranged to control above clutches 124, 137 and 141 based on the detected results of the sensors 113-115.

A temperature sensor TS is a temperature detecting device for detecting ambient temperature associated with the image forming apparatus. In FIG. 1, the temperature sensor TS detects the surface temperature of the photosensitive drum 31. However, it is possible to appropriately set the temperature sensor TS in other places in the image forming apparatus. The temperature sensor TS is connected to the controller 151 which is arranged to control the electro-magnetic clutch 137 based on the detected results of the temperature sensor TS. Concretely, the controller 151 is arranged to operate the electro-magnetic clutch 137 for a fourth predetermined time interval when the temperature is not less than the first predetermined temperature, and not to operate the electro-magnetic clutch 137 when the temperature is less than the first predetermined temperature.

Sheet feeding operation of the feeding apparatus 100 will be described by referring to FIG. 5.

Figure 5:
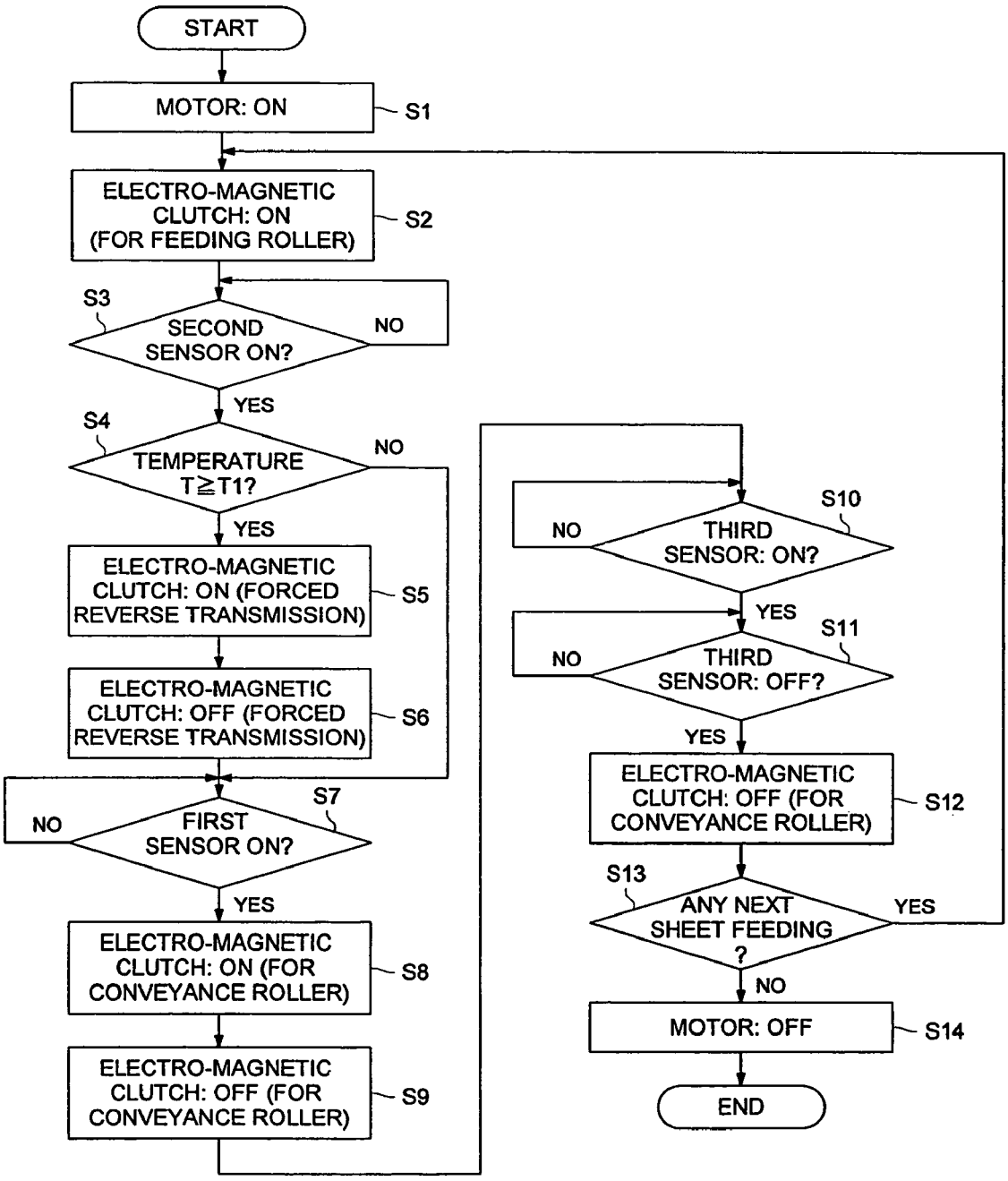
FIG. 5 illustrates a flow chart of embodiment 1 of the feeding apparatus of the invention.

FIG. 5 is a flow chart showing tasks, which have been divided into plural processes according to elapsed time.

The motor 120 starts rotating (step 1) when a command signal for feeding sheets PA is inputted to the controller 151 of the control device 150. In the limited reverse transmission mechanism 116B of the fist transmission mechanism shaft 130, rotational force of the motor 120 is transmitted to the shaft 130 via the transmission gear 122 and the gear 132, thereby the shaft 130 starts rotating based on this command. Then, the rotational force is transmitted to the separation roller 106 under the condition that the rotational force is limited by the torque limiter 107, and transmitted to the shaft 130 via the gears 134, 135 and 136. As a result the separation roller 106 rotates counterclockwise as shown in FIG. 2. At this moment, in the transmission mechanism 116A, since the electro-magnetic clutch 124 does not operate, the shaft 123 is in a state in which the shaft 123 freely rotes, and the sheet feeding roller 105 rotates according to the rotation of the separation roller 106.

After that, the electro-magnetic clutch 124 operates to connect the shaft 123 to the electro-magnetic clutch 124 and the rotational force of the motor 120 is transmitted to the shaft 123 via the transmission gear 122 and the clutch gear 125. Then the shaft 123 starts rotating. As a result, the rotational force is transmitted to the sheet feeding roller 104 and the sheet feeding roller 105, and the sheet feeding roller 104 and the sheet feeding roller 105 simultaneously start rotating in counterclockwise as shown in FIG. 2 (step 2). At this moment, even though the rotational force of the motor 120 is transmitted to the separation roller 106 via the torque limiter 107, since the rotational force of the motor 120 is transmitted to the paper feeding roller 106 as it has been by the operation of the electro-magnetic clutch 124, rotational force of the sheet feeding roller 105 is greater than that of the separation roller 106. Consequently, the separation roller 106 being in contacted with the sheet feeding roller 105 rotates according to the rotation of the sheet feeding roller 105.

When the sheet feeding roller 104 starts rotating, a single of sheets PA placed on the top of sheet-feeding tray 40 is sent to contacting portion of the sheet feeding roller 105 and the separation roller 106 from the sheet-feeding tray 40. The single of sheets PA is conveyed to the conveyance roller 108 side while being sandwiched by the sheet feeding roller 105 and the separation roller 106.

After that, the controller 151 determines whether any sheets PA exist based on the output of the second sensor 114 (step S3). When the second sensor 114 does not detect sheets PA (step S3: No), the operation of step S3 continues until the second sensor 114 detects sheet PA. When the second sensor 114 detects the leading edge of sheets PA (step S3: Yes), the controller 151 determines whether the temperature measured by the temperature sensor TS is not less than first predetermined temperature T1 (step S4).

When temperature is not less than first predetermined temperature T1 (step S4: YES), the rotational force of the motor 120 is transmitted to the shaft 131 via the transmission gear 122 and the gears 132, 133 and the clutch gear 138 by the operation of the electro-magnetic clutch 137 for connecting the shaft 131 to the electro-magnetic shaft 137. Consequently, the shaft 131 starts rotating. Then the rotational force is transmitted to the separation roller 106 from the gear 139 via the gears 134, 135 and 136. The rotational force is applied to the separation roller 106 so that the separation roller 106 conveys sheets PA in a direction which is reverse to the paper feeding direction of the sheet feeding roller 105.

Before the electro-magnetic clutch 137 starts operation, the rotational force of the shaft 130 is transmitted to the separation roller 106 via the torque limiter 107. Once the electro-magnetic clutch 137 operates in the operation of step S5, the separation roller 106 is forcefully driven by the forced reverse transmission mechanism 116C. Accordingly, the sheet feeding roller 105 and the separation roller 106 acts against sheet PA with the conveyance forces being reverse directions each other in the operation of step S5.

In this situation described above, when a single sheet of sheets PA is fed from the sheet-feeding tray 40, since the outer periphery of the sheet feeding roller 105 is structured by a material having a larger friction coefficient than that of the separation roller 106, the separation roller 106 rotates as the separation roller 106 slips on the lower surface of the sheet while the sheet feeding roller 105 continue to convey the sheet to the side of conveyance roller 108. When plural sheets PA being overlapped are sent out from the sheet feeding tray 40, the sheet feeding roller 105 continues rotating counterclockwise to convey the sheet of sheets PA positioned on the top of sheets PA to the conveyance roller 108 side as shown in FIG. 2. The separation roller 106 continues rotating counterclockwise as shown in FIG. 2, and to convey the sheets positioned in the lower side of sheet PA to the sheet feeding tray 40 while being in touch with double fed sheets PA. Namely, when the electro-magnetic clutch 137 operates in the operation of step S5 and overlapped plural sheets PA are fed out from the sheet feeding tray 40, a sheet positioned on the top of the plural sheets PA is sent out to the conveyance roller 108 side. The other sheets PA are separated from the sheet positioned on the top and returned to the sheet feeding tray 40 side.

In the operation of step S5, the electro-magnetic clutch 137 continues operating for a fourth predetermined time interval and the operation of the electro-magnetic clutch 137 stops when the fourth predetermined time interval has passed (step S6). Then, the connection between the shaft 131 and the electro-magnetic clutch 137 is released. As a result, the clutch gear 138 freewheels and the transmission of rotational force from the shaft 131 to the separation roller 106 is intercepted. Namely, it comes to a state that the rotational force being transmitted through the torque limiter 107 to the shaft 130 is transmitted to the separation roller 106.

When the temperature is less than a predetermined temperature T1 in step S4 (step S4: NO), steps S5 and S6 described above do not operate and will be omitted.

After that, the controller 151 determines whether the first sensor 113 detects a sheet or not. When first sensor 113 does not detect sheets PA (step S7: No), the operation of step S7 is repeated until the first sensor 113 detects the edge of sheets PA. When the first sensor 113 detects the edge of sheets PA (step S7: YES), the electro-magnetic clutch 141 (refer to FIG. 7) operates and the conveyance roller 108 rotates in a counterclockwise as shown in FIG. 2 (step S8). Then, the edge of sheets PA being passed through the pressing section of the sheet feeding roller 105 and the separation roller 106 is sandwiched between the conveyance roller 108 and the following roller 109. As a result, the sheet PA passes through the contacting portion of the conveyance roller 108 and the following roller 109 in accordance with the rotation of the conveyance roller 108.

After that, the operation of the electro-magnetic clutch 124 stops (step S9). Then the connection between the shaft 123 and the electro-magnetic clutch 124 is released and the clutch gear 125 freewheels. The transmission of rotational force from the transmission gear 122 to the sheet feeding roller 104 and the sheet feeding roller 105 is intercepted.

After that, the controller 151 determines whether the third sensor 115 detects any sheet PA (step S10). When the third sensor 115 does not detect any sheets PA (step S10: NO), the operation of step S10 repeats until the third sensor 115 detects sheets PA. When the third sensor 115 detects sheets PA (step S10: YES), controller 151 determines whether the third sensor 115 detects any sheet PA again (step S11). While the third sensor detects sheet PA (step S11: NO), the operation of step S11 continues.

When the third sensor 115 comes to the condition that the third sensor 115 does not detect any sheets PA (step S11: YES), namely, the rear edge of sheet PA passes through the portion where the third sensor 115 detects sheet PA, the operation of the electro-magnetic clutch 141 stops (step S12). Then the rotational force from the motor 120 to the conveyance roller 108 is intercepted.

After that, the controller 151 determines whether there is a signal for directing the next sheet feeding operation (step S13). When the signal for directing the next sheet feeding operation has been inputted (step S13: YES), the abovementioned operations of steps 2-12 repeat. When no signal for direction the next sheet feeding operation has been inputted (step S13: NO), the rotation of the motor 120 stops (step S14) and the operations of the feeding apparatus 100 finishes.

In the feeding apparatus 100, when temperature detected by the temperature sensor TS is not less than the first predetermined temperature T1, the separation roller 106 is forcefully rotated by the rotational force from the motor 120 via the forced reverse transmission mechanism 116C based on the temporary operation of the electro-magnetic clutch 137 of the forced reverse transmission mechanism 116C in the operation of step S5 while rotational force of the motor 120 is transmitted to the separation roller 106 via the limited reverse transmission mechanism 116B. Accordingly, more larger reverse transmission force is applied to sheet PA while a predetermined reverse transmission force is applied to the abovementioned sheet PA. Consequently, when the predetermined reverse transmission force cannot separate plural sheets PA being overlapped in the lower side between the sheet feeding roller 105 and the separation roller 106, more larger reverse transmission force than the predetermined reverse transmission force can be applied to the sheet PA being in contact with the separation roller 106. As a result, the sheets PA being overlapped in the plural sheets PA in the lower side can be securely separated.

In higher temperature, the separability of overlapped sheets is lowered and so called double-feed which is phenomenon that overlapped sheets having more than two sheets are fed from the feeding apparatus 100, tends to occur. The double feed in a higher temperature can be prevented by forcefully driving the separation roller 106 in a reverse direction. With regard to the threshold of the determination, is, for example, set at T1=29° C.

Further, since in the feeding apparatus 100, reverse transmission force applied to the separation roller 106 for reversely transmitting sheet PA can be transmitted through only two simple configurations which are the limited reverse transmission mechanism 116B for transmitting rotational force to the separation roller 106 and the forced reverse transmission mechanism 116C, it is not necessary to have a complicated configuration to adjust pressing force of the separation roller 106 being given to the sheet feeding roller 105 and forced power to be applied to the separation roller 106 as they have been conducted in a conventional configuration. Accordingly, it becomes possible to securely prevent that overlapped plural sheets PA are conveyed without adjusting pressing force of the separation roller 106 against the sheet feeding roller 105 and rotational force applied to the separation roller 106.

The present invention is not limited to the above embodiment and various changes and modification may be made without departing from the scope of the invention.

In the embodiment described above, the operation time period of the clutch 137 in step S5 is set at the fourth predetermined time interval. However it may be changed in accordance with the kind of sheet PA. In this case, the time interval may be changed by a keyboard or a touch panel in accordance with the kind of sheets. It is also possible to configure a system for memorizing time table having time corresponding to the kind of sheet PA in advance, and automatically selecting the operation time of the electro-magnetic clutch 137 after the kind of sheets PA is inputted by the operations of the keyboard or the touch panel.

Further it is also possible to configure a system having sensors for detecting the transmission factor, such as, reflectivity, thickness and the size of sheet PA. Based on the detected results of these sensors, the control device 150 and the controller 151 may determine the kind of sheet PA, the existence of the action and the operation time period of the electro-magnetic clutch 137. In accordance with the embodiment described above, double feeding at higher temperature where the separability of overlapped sheets is lowered can be prevented and high rate paper feeding can be securely conducted. Since the driving time interval of separation by the forced reverse transmission mechanism is precisely controlled, conveyance of sheets becomes stable and double feeding can be securely prevented. Further, the operation time interval of the forced reverse transmission mechanism is appropriately arranged for various conditions, double feeding under various conditions can be steadily prevented.

Embodiment 2

Embodiment 2 will be described by referring FIGS. 6-8.

Since FIG. 2 illustrates a side view of the feeding apparatus of the embodiment, the description used for embodiment 1 illustrated in FIG. 2 will be used. However, a driving system is different from the one used in embodiment 1.

Figure 6:
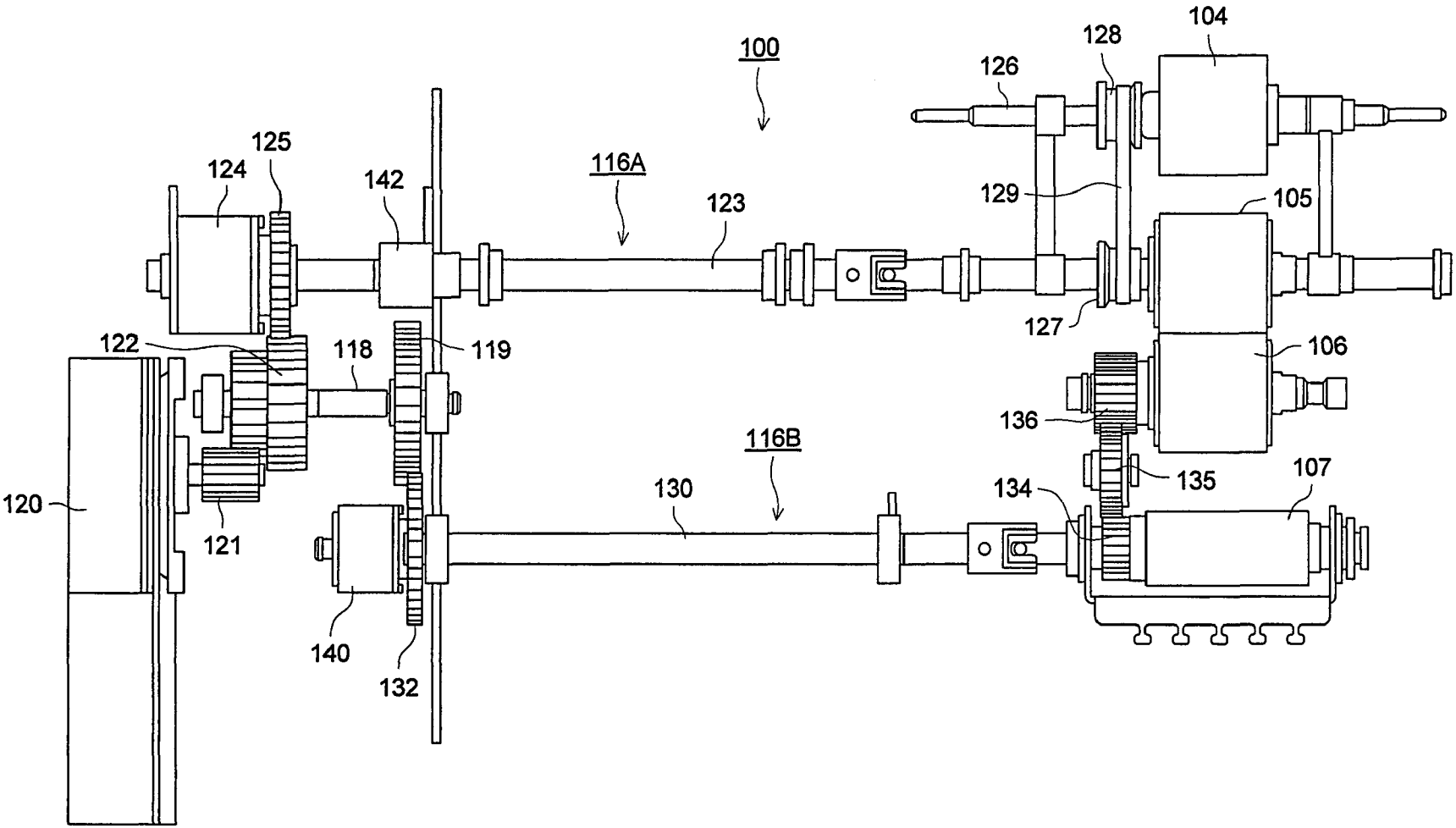
FIG. 6 illustrates a side view of embodiment 2 of the feeding apparatus of the invention.

FIG. 6 is a front view of a feeding apparatus 100.

The feeding apparatus 100 comprises a sheet feeding roller 104, a sheet feeding roller 105 and a motor 120 as a driving power source for a separation roller 106. An output shaft of the motor 120 includes the gear 121. The gear 121 engages a transmission gear 122 for transmitting rotational force of the motor 120 to the sheet feeding roller 104 and the sheet feeding roller 105. A transmission gear 119 for transmitting rotational force of the motor 120 to the separation roller 106 is fixed on a rotational shaft 118. The feeding apparatus 100 includes a feeding force transmission mechanism 116A for transmitting rotational force of the motor 120 from the transmission gear 122 to the sheet feeding roller 104 and the sheet feeding roller 105, and a limited reverse transmission mechanism 116B for transmitting rotational force of the motor 120 from the transmission gear 119 to the separation roller 106.

In the feeding force transmission mechanism 116A, a shaft 123 which can freely rotate around the shaft is arranged. In FIG. 6, there is provided an one-way clutch 142 for limiting the rotational direction of the shaft 123 in one way and the electro-magnetic clutch 124 for switching transmission of rational force of the motor 120 to the sheet feeding roller 104 and the sheet feeding roller 105. A clutch gear 125 of the electro-magnetic clutch 124 engages the transmission gear 122. In FIG. 6, the sheet feeding roller 105 is fixed on the right of the shaft 123. Pulleys 127 and 128 are respectively fixed on the shaft 123 and a rotational shaft 126 of the sheet feeding roller 104, and an endless belt 129 is entertained around pulleys 127 and 128.

In the feeding force transmission mechanism 116A, when the electro-magnetic clutch 124 is turned on for operation while the motor 120 is rotating, the shaft 123 comes to connect with the electro-magnetic clutch 124, and rotational force of the motor 120 is transmitted to the shaft 123 via the transmission gear 122 and the clutch gear 125 to rotate the shaft 123. Once the shaft 123 rotates, the sheet feeding roller 105 rotates. Further the rotational force is transmitted to the rotational shaft 126 via the belt 129. As a result the sheet feeding roller 104 and the sheet feeding roller 105 simultaneously rotate in the same direction.

When the electro-magnetic clutch 124 turns off to stop operation while the motor 120 is in an operation mode, the connection between the shaft 123 and the electro-magnetic clutch 124 is released, the clutch gear 125 freewheels and the rotation of the shaft 123 stops. Since the transmission of rotational force from the transmission gear 122 to the shaft 123 is intercepted, the rotation of the sheet feeding roller 104 and the sheet feeding roller 105 simultaneously stops. Namely, in the feeding force transmission mechanism 116A, the sheet feeding roller 104 and the sheet feeding roller 105 are arranged to synchronously operate based on the operation and halt of electro-magnetic clutch 124. Further, since the one-way clutch 142 is provided on the shaft 123, the sheet feeding roller 105 does not reversibly rotate to follow the rotation of the separation roller 106.

On the other contrary, in the limited reverse force transmission mechanism 116B, the shaft 130 capable of freely rotating around the axis of the shaft is provided. In FIG. 6, there is provided the electro-magnetic clutch 140, which is an electro-magnetic clutch 140 used for torque limiter, the electro-magnetic clutch 140 being used to switch for transmitting the rotational force of the motor 120 to the separation roller 106 or not. The clutch gear 132 of the electro-magnetic clutch 140 engages transmission the gear 119. In FIG. 6, a torque limiter 107 is provided on the right end of the shaft 130. A gear 134 is provided in the left side of the torque limiter 107 and the gear 134 engages a gear 135. A gear 136 is fixed on the shaft of the separation roller 106 and the gear 136 engages the gear 135.

In the limited force transmission mechanism 116B, when the electro-magnetic clutch 140 turns on to start operation, while the motor 120 is in an operation mode, the shaft 130 is arranged to rotates as the shaft 130 comes to contact with the electro-magnetic clutch 140 and rotational force of the motor 120 transfers to the shaft 130 via the transmission gear 119 and the clutch gear 132. Once the shaft 130 comes to rotate, the rotational torque is transmitted to the separation roller 106 via the gears 134, 135 and 136 while the rotational torque is in a limited mode. The separation roller 106 is arranged to rotate to convey sheet PA to the reverse direction against the sheet conveyance direction of the sheet feeding roller 104 and the sheet feeding roller 105. Namely, in the limited force transmission mechanism 116B being different from above the feeding force transmission mechanism 116A, since the torque limiter 107 is provided between the shaft 130 and the separation roller 106, all of rotational force of the motor 120 does not transmit to the conveyance roller 106. Accordingly, only limited and constant rotational force is arranged to transmit from the motor 120 to the separation roller 106.

When the electro-magnetic clutch 140 turns off to stop operation while the motor 120 is in an operation mode, and the connection between the shaft 130 and the electro-magnetic clutch 140 is released, the clutch gear 132 freewheels and the rotation of the shaft 130 stops. Since the transmission of rotational force from the transmission gear 119 to the shaft 130 is intercepted, the separation roller 106 and the shaft 130 are arranged to rotate following to the rotation of the sheet feeding roller 105.

Although they are not shown in FIGS. 2 and 6, in the feeding apparatus 100, the same as the feeding force transmission mechanism 116A described above, the shafts, the gears and an electro-magnetic clutch 141 (refer to FIG. 7) etc., are provided. A conveyance roller 108 is arranged to rotate based on the operation of the electro-magnetic roller 141.

Next, the circuit configuration of the feeding apparatus 100 will be described referring to FIG. 7.

Figure 7:
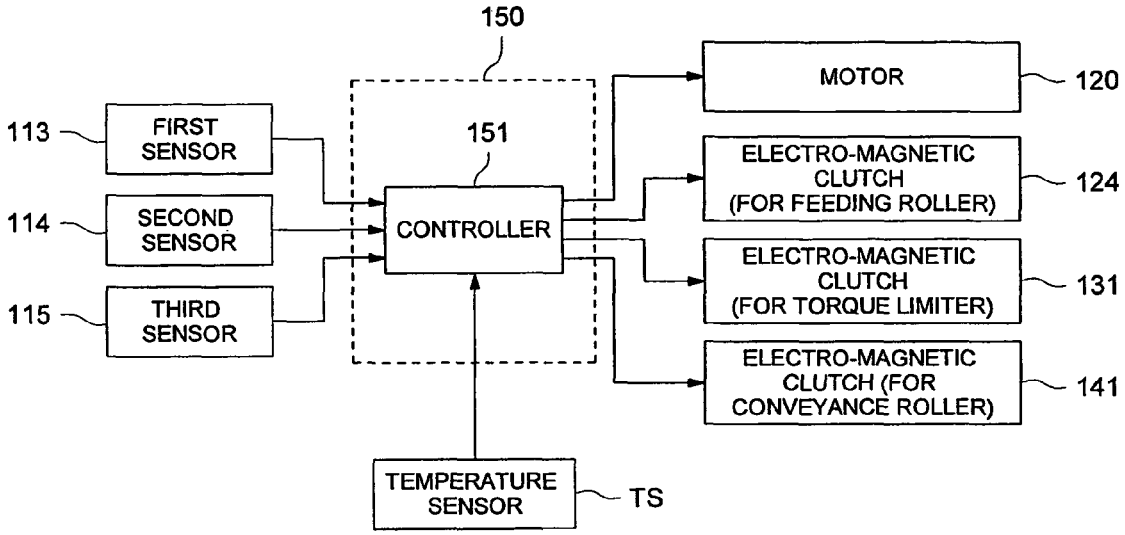
FIG. 7 illustrates a circuit diagram of embodiment 2 of the present invention.

FIG. 7 is a block diagram showing the configuration of a control device 150 of the feeding apparatus 100.

The controlling device 150 includes a controller 151 configured by a general-purpose CPU (Central Processing Unit), a ROM (Read Only Memory), a RAM (Random Access Memory) and a circuit, such as, a non-volatile memory (not shown). The controller 151 is designed to transfer a processing-program from the ROM to the RAM whereby the CPU executes the processing program.

Concretely, the controller 151 is arranged to the operation of the above motor 120 and components of the each electro-magnetic clutches 124, 140 and 141. Particularly, in the feeding apparatus 100, sensors 113-115 are connected to the controller 151 and the controller 151 is arranged to control the each electro-magnetic clutch 125, 140 and 141 based on the detected result of the each first to third sensors 113-115.

A temperature sensor TS is a sensor to detect ambient temperature and it detects the surface temperature of the photosensitive drum 1 as shown in FIG. 1. The temperature sensor TS can be appropriately placed on any place other than the place shown in FIG. 1.

Next, the feeding operation of the feeding apparatus 100 will be described by referring to FIG. 8.

Figure 8:
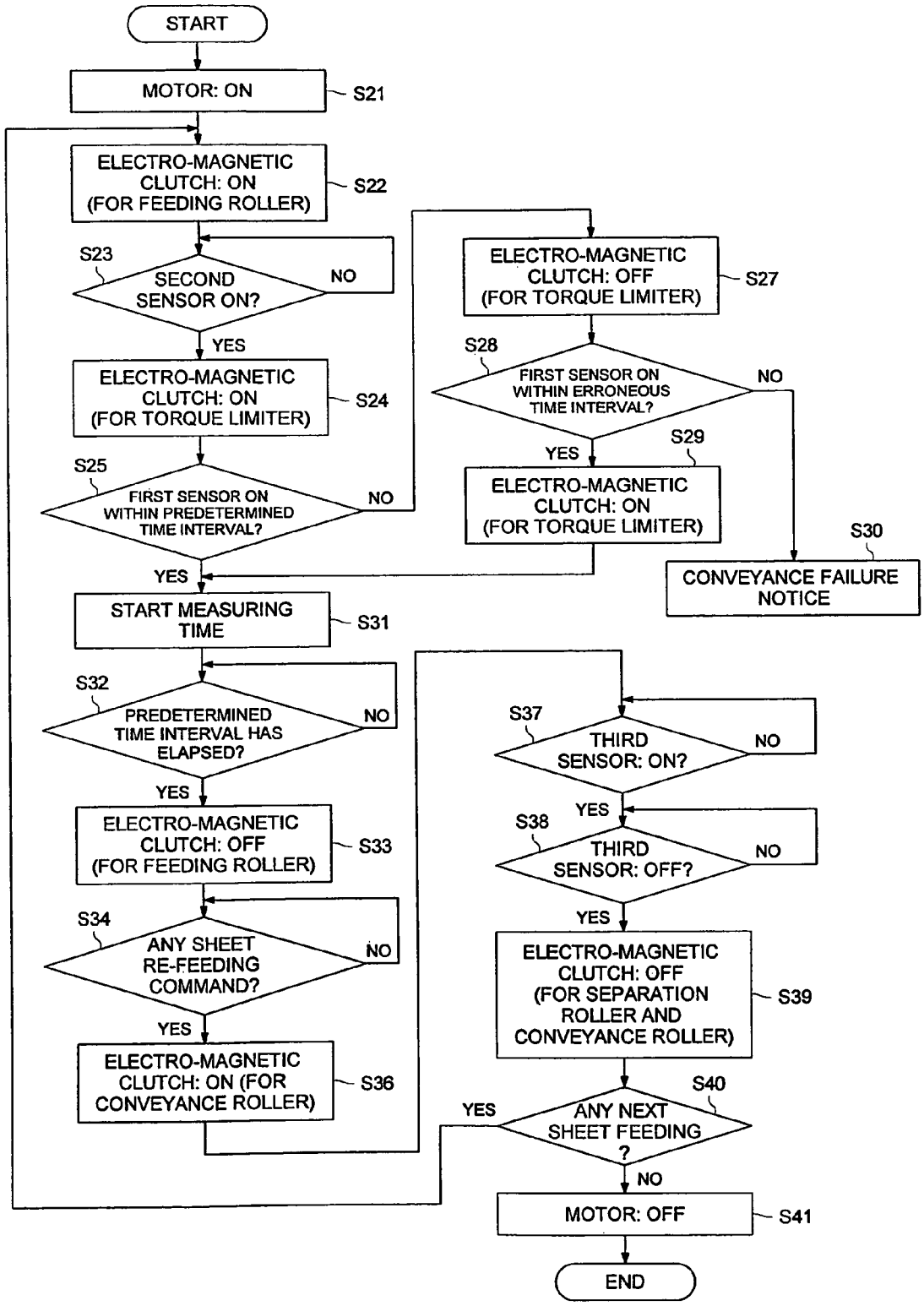
FIG. 8 illustrates a flow chart of embodiment 2 of the feeding apparatus of the invention.

FIG. 8 is the flowchart showing tasks, which have been divided into plural processes according to the elapsed time.

When a signal for directing sheet feeding of sheet PA is inputted to the controller 151 of the control device 150, the motor 120 starts rotating (step S21). After that, the electro-magnetic clutch 124 operates to connect the shaft 123 to the electro-magnetic clutch 124, and rotational force of the motor 120 transmits to the shaft 123 via the transmission gear 122 and the clutch gear 125. Then the shaft 123 starts rotating. Then the rotational force transmits from the shaft 123 to the sheet feeding roller 104 and the sheet feeding roller 105. The sheet feeding roller 104 and the sheet feeding roller 105 simultaneously start rotating counterclockwise as shown in FIG. 2 (step S22). When the sheet feeding roller 104 starts rotating, a single sheet PA placed on the top of the sheet-feeding tray 40 is sent to contacting portion of the sheet feeding roller 105 and the separation roller 106 from the sheet-feeding tray 40. The sheet PA is conveyed to the conveyance roller 108 side while being sandwiched by the sheet feeding roller 105 and the separation roller 106.

After that, the controller 151 determines whether the sheet PA is detected by the second sensor 114 or not (step S23). When the second sensor 114 does not detect the sheet PA (step S23: No), the operation of step S23 continues until the second sensor 114 detects the sheet PA. When the second sensor 114 detects the leading edge of sheet PA (step S23: Yes), the electro-magnetic clutch 140 operates to connect the shaft 130 to the electro-magnetic clutch 140 and rotational force of the motor 120 transmits from the transmission gear 119 to the shaft 130 via the clutch gear 132. Consequently the shaft 130 starts rotating. Then, the rotational force transmits from the shaft 130 to the separation roller 106 via the gears 134, 135 and 136. As a result, the separation roller 106 receives rotational force so that the separation roller 106 conveys sheet PA in a reverse direction against the sheet feeding direction of the sheet feeding roller 105 (step 24).

When a single sheet of sheets PA is fed from the sheet-feeding tray 40 in this situation described above, the sheet feeding roller 105 continue conveying sheet PA to the conveyance roller 108 side and since the separation roller 106 receives rotational force of the motor 120, which is limited by the torque limiter 107, the separation roller 106 rotates following to the rotation of the sheet feeding roller 105 while the separation roller 105 is in touch with sheet PA. On the contrary, when plural sheets PA being overlapped are sent out from the sheet feeding tray 40, the sheet feeding roller 105 continues rotating counterclockwise to convey the single sheet of sheets PA positioned on the top of sheets PA to the conveyance roller 108 side as shown in FIG. 2. The separation roller 106 continues rotating counterclockwise as shown in FIG. 2 and to convey sheets positioned in the lower side of sheets PA to the sheet feeding tray 40 side while being in touch with overlapped sheets PA. Namely, when overlapped plural sheets PA are fed out from the sheet feeding tray 40, a sheet positioned on the top of the plural sheets PA is sent out to the conveyance roller 108 side. The other sheets PA (sheet PA positioned lower side among plural overlapped sheets PA) are separated from the sheet positioned on the top.

After that, the controller 151 determines whether the time interval from the moment when the second sensor 114 detects the leading edge of sheet PA in the operation of step 23 to the moment when the first sensor 113 detects the leading edge of sheet PA falls within the first predetermined time interval (step 25). Here, the first predetermined time interval means a barometer used for determining whether conveyance of sheet PA is correctly performed and the value of the first predetermined time interval is stored in the non-volatile memory in the control device 150.

When the time interval from the moment when the second sensor 114 detects the leading edge of the sheet PA in the operation of step 23 to the moment when the first sensor 113 detects the leading edge of the paper is within the first predetermined time interval (step S25: YES), namely, the first sensor 113 detects the leading edge of sheet PA within the first predetermined time interval, the controller 151 starts measuring time (step S31).

The first predetermined time interval is set corresponding to the ambient temperature, and the table of the first predetermined time interval corresponding to the temperature is stored in the non-volatile memory of the control device 150. The controller 151 determines the first predetermined time interval by referring to the table based on the detected temperature of the temperature sensor TS.

In low temperature, conveyance rollers, such as sheet feeding roller 104 and sheet feeding roller 105 and sheets tend to slip each other. Accordingly, conveyance power of the conveyance roller lowers and no-feed tends to occur. In the low temperature, by setting the first predetermined time interval short and speedily conducting sheet-feed under the condition that the resistance of the separation roller is released, no-feed can be well prevented.

Namely, it becomes possible to securely prevent no-feed by setting the first predetermined time interval based on the ambient temperature for the determination in step 25.

The first predetermined time interval may be continuously changed or changed stepwise.

After that, the controller 151 determines whether the elapsed time from the moment when starting measurement of the elapsed time reaches to the second predetermine time interval (step 32). When determining that the elapsed time has not reached to the second predetermined time (step 32: NO), the controller 151 continues the process of step 32 from the moment when starts measuring time interval at step 31 to the moment when time has reaches to the predetermined time interval.

When the controller 151 determines that the elapsed time has reached to the second predetermine time interval from the moment when starts measuring of time interval in step S31 (step S32: YES), the operation of the electro-magnetic clutch 124 is stopped (step S33). Then the connection between the shaft 123 and the electro-magnetic clutch 124 is released and the clutch gear 125 freewheels. Accordingly, rotational force from the transmission gear 122 to the sheet feeding roller 104 and the sheet feeding roller 105 is intercepted.

After that, the controller 151 determines whether a signal for directing the restart of feeding sheet PA is inputted (step S34). When determined that the directing signal has not inputted (step S34: NO), the controller 151 continues the process of step 34 until the signal for directing the restart of feeding sheet PA is inputted. When the controller 151 determines that the signal for directing the restart of feeding sheet PA has inputted (step S34: YES), the electro-magnetic clutch 141 operates to rotate the conveyance roller 108 counterclockwise as shown in FIG. 2 (step S36).

On the contrary, when the elapsed time from the moment when the second sensor 114 detects the leading edge of sheet PA to the moment when the first sensor 113 detects the leading edge of sheet PA does not fall within the first predetermined time interval (step S25: NO), namely, the first sensor 113 does not detects the leading edge after the first predetermined time interval has passed, the controller 151 stops operation of the electro-magnetic clutch 140 (step S27). Then the connection between the shaft 130 and the electro-magnetic clutch 140 is released and the clutch gear 132 freewheels. As a result, rotational force from the transmission gear 119 to the separation roller 106 is intercepted.

In this situation, since the sheet feeding roller 105 continues rotating even though the separation roller 106 stops rotating, sheet PA fed out from the sheet-feeding 40 is conveyed by the action of the sheet roller 105 to the conveyance roller 108 side, whichever the number of sheet PA is a peace of sheet or plural sheets.

After that, the controller 151 determines whether the time from the moment when the second sensor 114 detects the leading edge of sheet PA in step S23 to the moment when the first sensor 113 detects the leading edge of sheet PA is equal to or less than a third predetermined time being an erroneous time (step S28). Here, the erroneous time is a parameter for determining whether conveyance error of sheet PA occurs and the third erroneous time is set longer than the first predetermined time. The value of the third erroneous time is stored in the non-volatile memory in the control device 150 as the same as the above first predetermined time.

When the time from the moment when the second sensor 114 detects the leading edge of sheet PA in step S23 to the moment when the first sensor 113 detects the leading edge of sheet PA is equal to or less than third predetermined time interval (step 28: YES), namely, the first sensor 113 detects the leading edge of sheet PA within the third predetermined time interval, the electro-magnetic clutch 140 restarts operation so that the rotational force transmits to the separation roller 106 to convey sheet PA in the direction being reverse direction against the paper feeding direction of the feeding roller 105 (step S29).

In this situation, when a single sheet of sheet PA is fed from the sheet-feeding tray 40, the sheet feeding roller 105 continues rotating to convey sheet PA to the conveyance roller 108 side as the same situation after the operation of step 24 and the separation roller 106 rotates following to the rotation of the sheet feeding roller 105. When plural sheets of sheet PA are fed out from the sheet-feeding tray 40, the sheet feeding roller 105 continues rotating to convey the single sheet of sheet PA positioned on the top of the plural sheets to the conveyance roller 108 side, and the separation roller 106 returns overlapped sheets positioned lower side of the plural sheets of sheet PA to the sheet-feeding tray 40 side.

When the elapsed time from the moment when the second sensor 114 detects the leading edge of sheet PA to the moment when the first sensor 113 detects the leading edge of sheet PA does not fall within the first predetermined time interval (step S28: NO.), namely, the first sensor 113 does not detects the leading edge after the first predetermined time interval has passed, the controller 151 conducts the process for sending information of conveyance failure of sheet PA (step S30). In this embodiment, mechanical operations of each member of the sheet feeding apparatus 100 stop. However, a display (not shown) provided in the sheet feeding apparatus 100 may display the message and a buzzer (not shown) provided in the sheet feeding apparatus 100 may automatically sound. In step 23, the controller 151 determines whether the time interval from the moment when the second sensor 114 detects the leading edge of sheet PA to the moment when the first sensor 113 detects the leading edge of sheet PA is equal to or less than the third predetermined time. However, in step S28, in the case of the apparatus arranged to temporally stop driving the sheet feeding roller 104 or the sheet feeding roller 105, etc., when the second sensor 114 detects the leading edge of sheet PA, the controller 151 determines whether the time interval from the moment when restarting the drive of the sheet feeding roller 104 or the sheet feeding roller 105 to the moment when the first sensor 113 detects the leading edger of sheet PA is equal to or less than the third predetermined time interval.

After the operation of step S29, the operations of steps S31 through step S36 are conducted. When the roller 108 rotates based on the operation of step S36, the leading edge of sheet PA passed through the pressing portion of the sheet roller 105 and the separation roller 106 is sandwiched between the conveyance roller 108 and the following roller 109. The sheet PA is conveyed to the outside of the sheet feeding apparatus 100 through the pressing portion of in accordance with the rotation of the conveyance roller 108.

After that, the controller 151 determines whether a sheet PA is detected by the third sensor 115 or not (step S37). When the third sensor 115 does not detect sheet PA (step S37: NO), the operation of step S37 continues until the third sensor 115 detect sheet PA. When the third sensor 115 detects the leading edge of sheet PA (step S37: YES), the controller 151 determines whether the sheet PA is detected by the sensor 115 or not, again (step S38). The operation of step 38 continues while the third sensor 115 is detecting sheet PA (step 38: NO).

When the third sensor 115 becomes not to detect sheet PA (step S38: YES), namely the rear edge of sheet PA has passed through the detecting portion of sheet PA by the third sensor 115, the operations of two electro-magnetic clutches 140 and 141 stop (step S39). Then the connection between the shaft 130 and the electro-magnetic clutch 140 is released and the clutch gear 132 freewheels, and the transmission of rotational force from the transmission gear 119 to the separation roller 106 is intercepted. At the same time, the rotational force from the motor 120 to the conveyance roller 108 is intercepted.

After that, the controller 151 determines whether there is a signal for directing the feeding of next sheet PA (step S40). When the signal for feeding sheet PA is inputted (step S40: YES), the operations of each member of steps S22-S39 repeatedly continue. When the signal for directing the feeding of next sheet PA has not been inputted (step S40: NO), rotation of the motor 120 stops (step S41) and feeding operation of the sheet feeding apparatus 100 completes.

In the sheet feeding apparatus 100, when first sensor 113 does not detect sheet PA while the rotational force is transmitted to the separation roller 106 based on the operation of the electro-magnetic clutch 140 in the operation of step S24, since the rotation of the electro-magnetic clutch 140 stops, no reverse force (no load) in the reverse direction against the conveyance direction is applied to sheet PA passing between the sheet feeding roller 105 and the separation roller 106. Accordingly, at this moment, since only rotational force of the sheet feeding roller 105 conveys sheet PA, it is possible to securely transmit rotational force of the sheet feeding roller 105 to sheet PA. As a result, since the sheet feeding roller 105 does not slip on the contacting surface with sheet PA, conveyance failure of sheet PA can be prevented.

From the different point of view, when the first sensor 113 does not detect sheet PA within the first predetermined time interval under the condition that rotational force is transmitted to the separation roller 106 by the operation of the electro-magnetic clutch 140 in step 24, the electro-magnetic clutch 140 temporarily stops operation and restarts after the first sensor 113 detects sheet PA. Accordingly, rotational forces before and after the temporary stop of the electro-magnetic clutch 140, are transmitted to the separation roller 106. As a result, the reverse force being in the direction opposed to the conveyance direction is applied twice to sheet PA passing through the contact portion of the feeding roller 105 and the separation roller 106.

Accordingly, when plural sheets of sheet PA pass through the contacting portion of the sheet feeding roller 105 and the separation roller 106, for example, in case that even though the reverse feeding force of the separation roller 106 firstly applied to the plural sheets, does not separate all plural sheets of sheet PA being overlapped under the top sheet of sheet PA, the latter reverse feeding force of the separation roller 106 can sufficiently separate overlapped sheets under sheet PA. As a result, it becomes possible to sufficiently prevent the conveyance of plural sheet of sheet PA.

Since first predetermined time interval for determining operation/non-operation of the electro-magnetic clutch 140 is set based on the detected information of the temperature sensor TS, no-feed caused by slipping between a sheet and a conveyance roller at low temperature can be well prevented. In accordance with current embodiment of the invention, no-feed caused by the characteristic that conveyance rollers and a sheet tend to slip each other in low temperature can be well prevented and high speed sheet feeding can be conducted. Since the management time for controlling the freewheel of the separation roller can be precisely set, conveyance becomes stable and no-feed can be securely prevented.

Embodiment 3

Embodiment 3 of the invention will be described by using. FIGS. 6, 9, 10 and 11.

Figure 9:
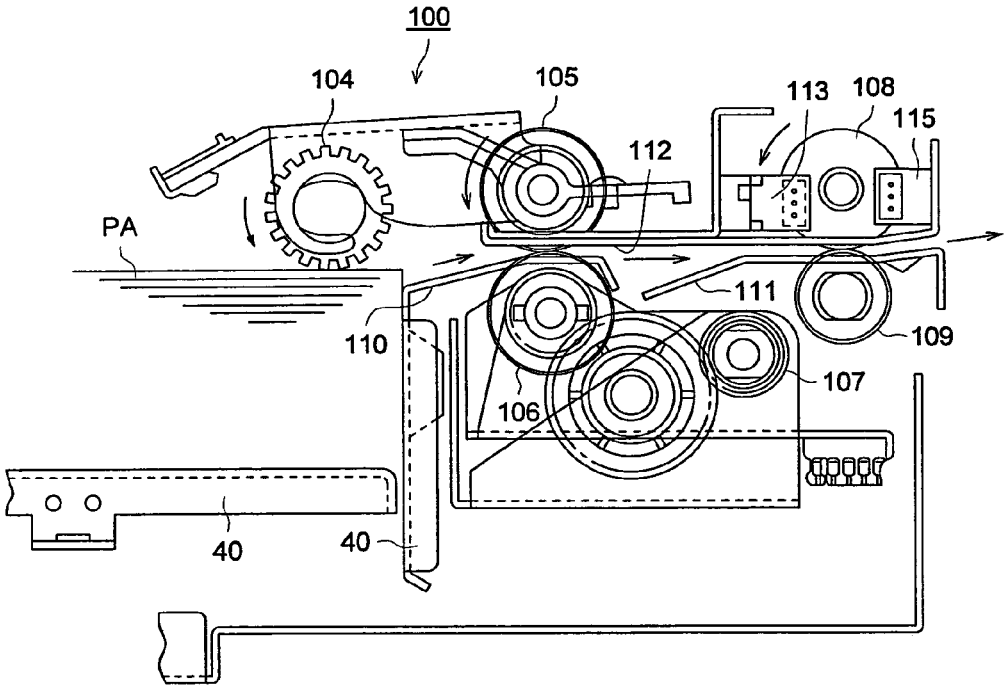
FIG. 9 illustrates a side view of embodiment 3 of the present invention.
Figure 10:
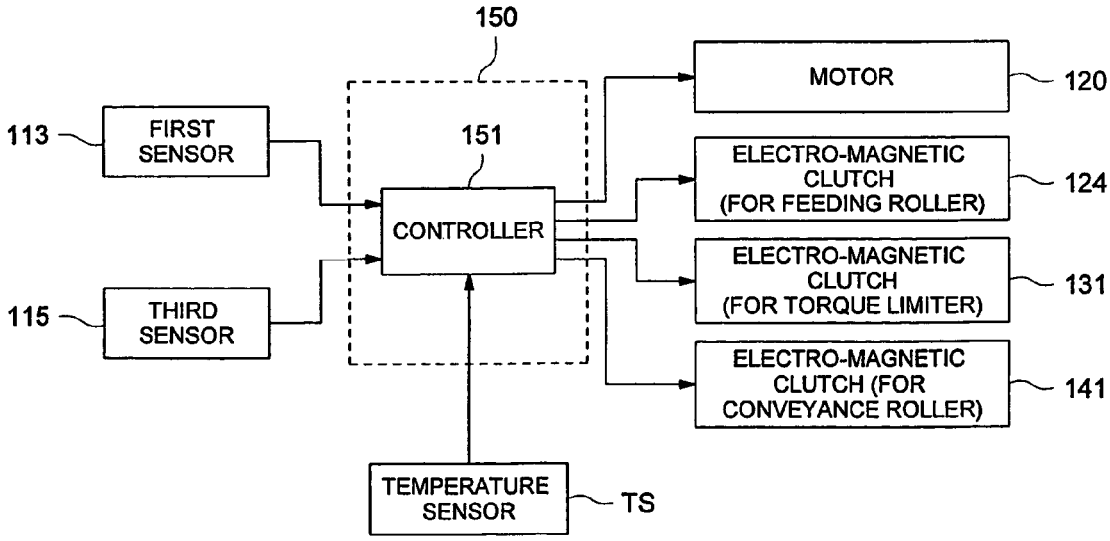
FIG. 10 illustrates a circuit diagram of embodiment 3 of the present invention.

In FIGS. 6, 9 and 10, with regard to commonly used components and the circuit, detailed explanations will be omitted by referring to the description described above. FIG. 6 illustrating the side view of embodiment 2 shows the driving system of the embodiment.

FIG. 9 is a side view of the sheet feeding apparatus 100 and FIG. 10 is a circuit diagram of embodiment 3 of the sheet feeding apparatus 100.

A different point between the sheet feeding apparatus 100 shown in FIG. 9 and the sheet feeding apparatus 100 shown in FIGS. 2 and 4 is that the second sensor 114 is omitted from the sheet feeding apparatus 100 shown in FIGS. 2 and 4, and others are the same as the sheet feeding apparatus 100 shown in FIGS. 2 and 4. In FIG. 10, first and third sensors 113 and 115 are connected to the controller 151, which is arranged to control electro-magnetic clutches 124, 140 and 141 based on the detected results of the first and third sensors 113 and 115.

The operation of the sheet-feeding apparatus 100 will be described by referring to FIG. 11.

Figure 11:
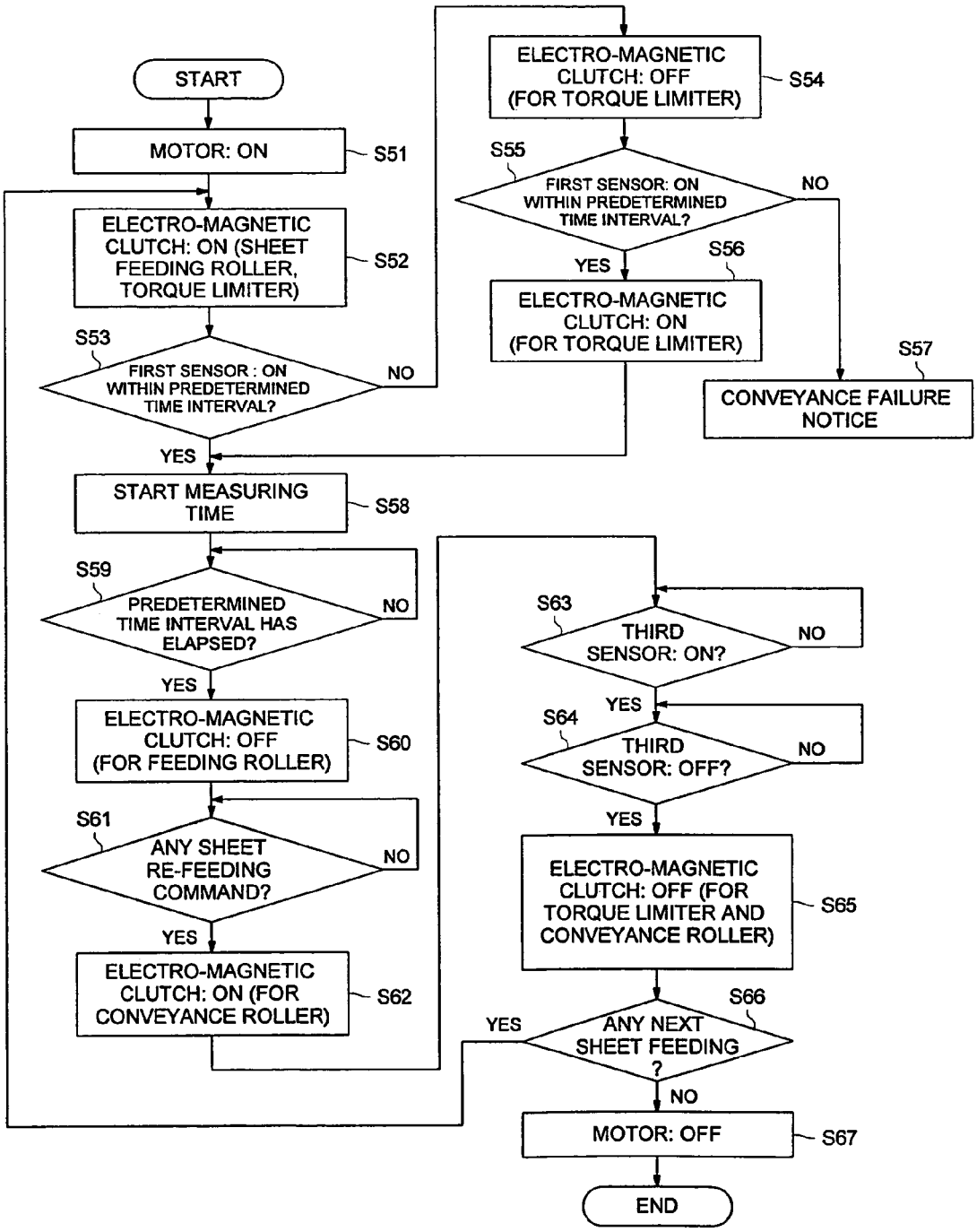
FIG. 11 illustrates a flow chart of embodiment 3 of the feeding apparatus of the invention.

FIG. 11 is a flowchart sequentially expressing plural processes of feeding operations of the sheet feeding apparatus 100.

When a signal for directing the feed of sheet PA is inputted to the controller 151 of the control device 150, the motor 120 stats rotating (step S51), then the electro-magnetic clutches 124 and 140 operate (step S52). When the electro-magnetic clutch 124 operates, the shaft 123 comes to contact with the electro-magnetic clutch 124 to transmit rotational force of the motor 120 to the sheet feeding roller 104 and the sheet feeding roller 105. The sheet feeding roller 104 and the sheet feeding roller 105 simultaneously stat rotating counterclockwise as shown in FIG. 9. When the electro-magnetic clutch 140 starts operating, the shaft 130 connects to the electro-magnetic clutch 140 to transmit rotational force of the motor 120 to the separation roller 106 via the torque limiter 107. As a result, the separation roller 106 receives a rotating force from the motor 120 in the reverse direction against the sheet feeding direction of the sheet feeding roller 105.

When the sheet feeding roller 104 starts rotating, a single sheet of sheet PA positioned on the top of the sheet feeding tray 40 is fed into the pressing portion of the sheet feeding roller 105 and the separation roller 106. The sheet feeding roller 105 conveys the single sheet of sheet PA to the conveyance roller 108 side while the single sheet of sheet PA is sandwiched between the paper feeding roller 105 and the separation roller 106.

When the single sheet of sheets PA is fed from the sheet-feeding tray 40 in this situation described above, the sheet feeding roller 105 continues conveying sheet PA to the conveyance roller 108 side and since the separation roller 106 receives rotational force of the motor 120, which is limited by the torque limiter 107, the separation roller 106 rotates following to the rotation of the sheet feeding roller 105 while the separation roller 105 is in touch with sheet PA. On the contrary, when plural sheets PA being overlapped are sent out from the sheet feeding tray 40, the sheet feeding roller 105 continues rotating counterclockwise to convey sheets PA positioned on the top of sheets PA to the conveyance roller 108 side as shown in FIG. 9. The separation roller 106 continues rotating counterclockwise as shown in FIG. 9 and to convey the sheets positioned in the lower side of sheet PA to the sheet feeding tray 40 side while being in touch with overlapped sheets PA.

After that, the controller 151 determines whether the time interval from the moment when the electro-magnetic clutch 124 starts operating in the operation of step 52 to the moment when the first sensor 113 detects the leading edge of sheet PA falls within the first predetermined time interval (step 53). Here, the first predetermined time interval is a barometer used for determining whether conveyance of sheet PA is correctly performed, the same as the first predetermined time interval described in the operation of step 25 of the first embodiment of the invention, and the value of the table corresponding to ambient temperature is stored in the non-volatile memory in the control device 150.

When the time from the start of operation of the electro-magnetic clutch 124 to the moment when the first sensor 113 detects the leading edge of sheet PA is equal to or less than the first predetermined time interval (step 53: YES), namely the first sensor 113 detects sheet PA within the first predetermined time interval, the controller 151 starts measuring time (step S58).

After that, the controller 151 determines whether elapsed time from the moment when stats measuring time of the process of step 58 has reached the second predetermined time interval (step S59). When determined that the elapsed time has not reached to the second predetermined time interval (step S59: NO), the process of step S59 repeats until the time reaches to the second predetermined time interval.

When the controller 151 determines that the elapsed time has reached to the second predetermine time from the moment when starts measuring time in step S58 (step S59: YES), the operation of the electro-magnetic clutch 124 is stopped (step S60). Then the connection between the shaft 123 and the electro-magnetic clutch 124 is released and the clutch gear 125 freewheels. Accordingly, rotational force from the transmission gear 122 to the sheet feeding roller 104 and the sheet feeding roller 105 is intercepted.

After that, the controller 151 determines whether signal for directing the restart of feeding sheet PA has been inputted (step S61). When determined that the directing signal has not inputted (step S61: NO), the controller 151 continues the process of step 34 until the signal for directing the restart of feeding sheet PA is inputted. When the controller 151 determines that the signal for directing the restart of feeding sheet PA has inputted (step S61: YES), the electro-magnetic clutch 141 operates to rotate the conveyance roller 108 in counterclockwise as shown in FIG. 5 (step S62).

On the contrary, when the elapsed time from the moment when the electro-magnetic clutch 124 starts operating to the moment when the first sensor 113 detects the leading edge of sheet PA does not fall within the first predetermined time interval (step S53: NO), namely, the first sensor 113 does not detects the leading edge after the first predetermined has passed, the controller 151 stops operation of the electro-magnetic clutch 140 (step S54). Then the connection between the shaft 130 and the electro-magnetic clutch 140 is released and the clutch gear 132 freewheels. As a result, rotational force from the transmission gear 119 to the separation roller 106 is intercepted.

In this situation, since the sheet feeding roller 105 continues rotating even though the separation roller 106 stops rotating, sheet PA fed out from the sheet-feeding tray 40 is conveyed by the action of the sheet roller 105 to the conveyance roller 108 side, whichever the number of sheet PA is a peace of sheet or plural sheets.

After that, the controller 151 determines whether the time from the moment when the electro-magnetic clutch 124 starts operation in step S52 to the moment when the first sensor 113 detects the leading edge of sheet PA is equal to or less than third predetermined time interval being an erroneous time (step S55). Here, the erroneous time is a parameter for determining whether conveyance error of sheet PA occurs, the same as the third predetermined time interval described in step S28 of the embodiment 2, and the third erroneous time interval is set longer than above first predetermined time interval. The value of the third erroneous time interval is stored in the non-volatile memory in control device 150 as the same as the above first predetermined time.

After that, the same operation of the sheet feeding apparatus 100 shown in the embodiment 2 is conducted. In respective operations of steps S56, S57 and S63-S68, the operation of step S56 corresponds to the operation of step S29; the operation of step 57 corresponds to the operation of step 30; the operation of step S63 corresponds to the operation of step S37; the operation of step S64 corresponds to the operation of step S38; the operation of step S65 corresponds to the operation of step S39; the operation of step 66 corresponds to the operation of step S40; and the operation of step 67 corresponds to the operation of step S41.

Namely, in the sheet feeding apparatus 100 of embodiment 2, the first predetermined time interval and the erroneous time interval at steps 25 and 28 are corresponding to the time from the moment when the second sensor 114 detects the sheet PA to the moment when the first sensor 113 detects the sheet PA. In stead, in the sheet feeding apparatus 100 of embodiment 3, in the sheet feeding apparatus 100 of embodiment 3, the first predetermined time interval and the erroneous time interval at steps 53 and 55 are corresponding to the time from the moment when the electro-magnetic clutch 124 starts operating to the moment when the first sensor 113 detects the sheet PA. This is a point in which the operation of the sheet feeding apparatus 100 and that of the sheet feeding apparatus 1 is different. Accordingly, in the above sheet feeding apparatus 100, the same as the sheet feeding apparatus 1, the conveyance failures of sheet PA can be prevented. (Conveyance of plural overlapped sheets of sheet PA can be prevented.) In accordance with an embodiment of the present invention, no-feed caused by the phenomenon that conveyance rollers and paper sheets tend to slip each other in low temperature can be well prevented and high speed sheet feeding-conveyance can be stably conduced.

Embodiment 4

An embodiment 4 of the invention will be described by applying FIGS. 2 and 12-14.

Figure 12:
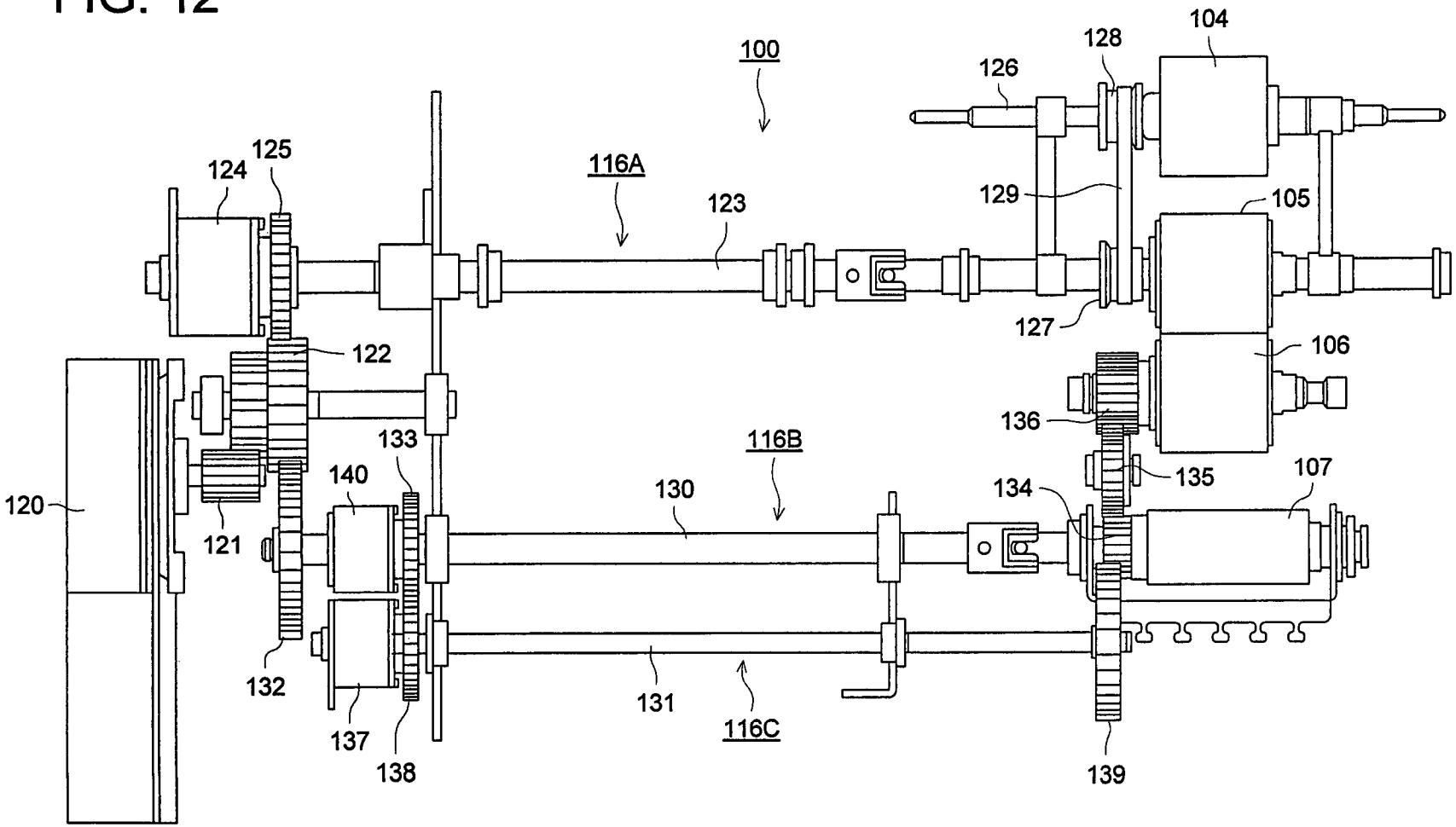
FIG. 12 illustrates a front view of embodiment 4 of the invention.

FIG. 2 is the side view of a sheet feeding apparatus of this embodiment of the invention. FIG. 12 illustrates a front view of a driving system.

This embodiment is arranged to selectively uses the limited reverse transmission mechanism 116B or the forced reverse transmission mechanism 116C based on ambient temperature and selectively use the separation roller 106 or makes the separation roller 106 free to follow the rotation of the sheet feeding roller 105 based on the ambient temperature. This embodiment is an image forming apparatus having an embodiment including the combination of embodiments 1, 2 and 3.

A sheet feeding apparatus 100 of the embodiment shown in FIG. 12 has the same structure as the sheet feeding apparatus shown in FIG. 3 except that the limited reverse transmission mechanism 116B includes the electro-magnetic 140 for limiting torque.

In the sheet feeding apparatus shown in FIG. 12, the rotational force of the motor 120 transmits to the separation roller 106 via the torque limiter 107 when the electro-magnetic clutch 140 operates and rotational force being a reverse direction against the sheet feeding direction transmits to the separation roller 106. When the electro-magnetic clutch 140 comes to stop, the separation roller 106 becomes free and follows the rotation of the sheet feeding roller 105.

Figure 13:
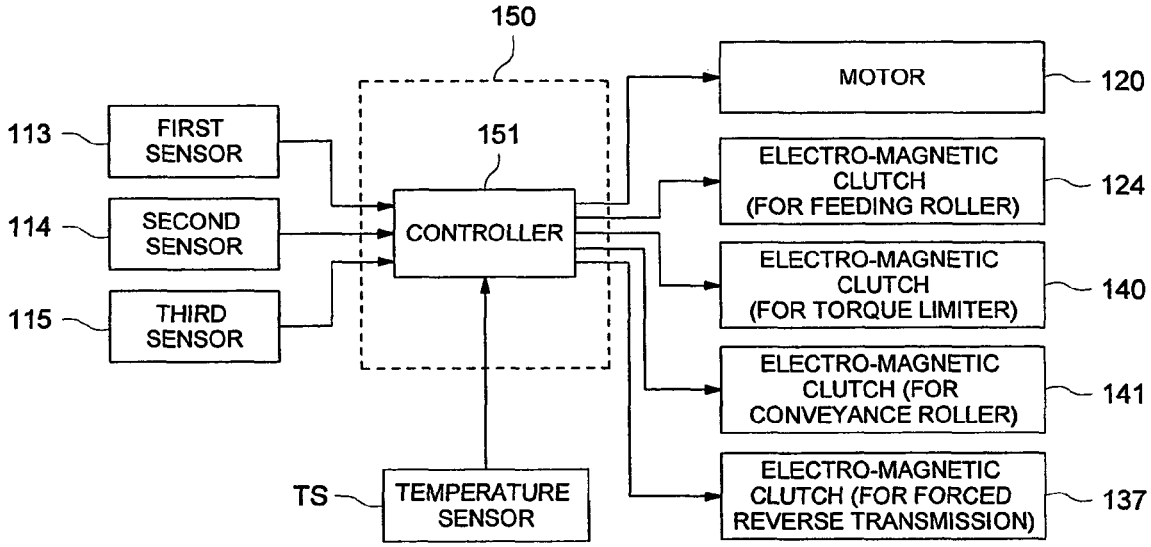
FIG. 13 illustrates a circuit diagram of embodiment 4 of the present invention.

FIG. 13 illustrates a block diagram of control circuit in an embodiment. As shown in FIG. 13, the control circuit is the same as the control circuit shown in FIG. 4 except it has an electro-magnetic clutch 140 being an electro-magnetic clutch for limiting torque.

Figure 14:
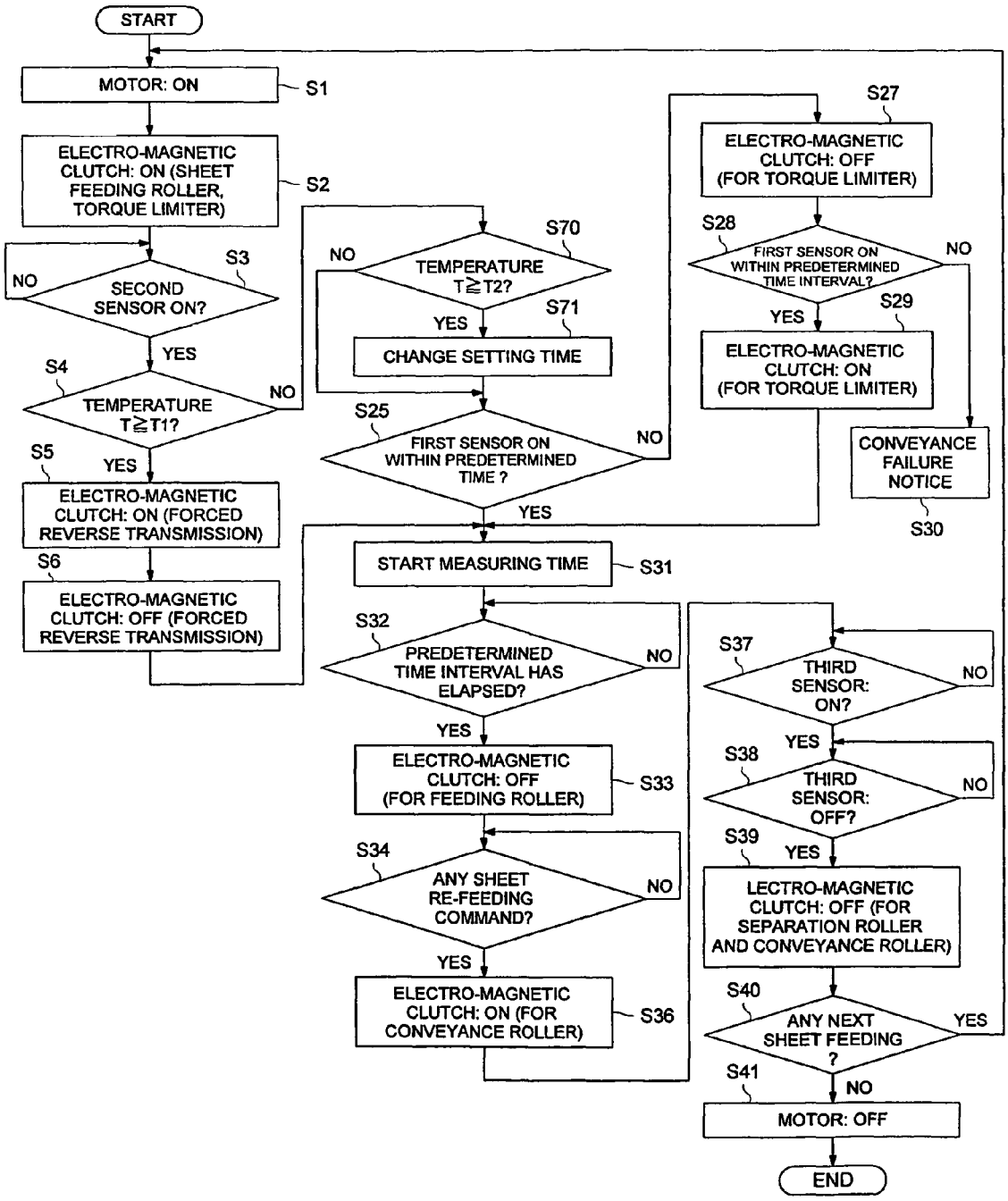
FIG. 14 illustrates a flow chart of embodiment 4 of the feeding apparatus of the invention.

The operation of the embodiment of the invention will be described by referring to FIG. 14, which is the flowchart showing the flowchart of the control flow of the embodiment.

When a signal directing the feed of sheet PA is inputted to the controller 151 of the control device 150, the motor 120 starts rotating (step S1).

After that, an electro-magnetic clutch 124 used for an electro-magnetic clutch of a paper feeding roller and, an electro-magnetic clutch 140 being an electro-magnetic clutch for limiting torque operate to connect a shaft 123 with the electro-magnetic clutch 124. Then the rotational force of the motor 120 transmits via a transmission gear 122 and a clutch-gear 125 to the shaft 123. Once the shaft 123 starts rotating, the rotational force transmits to the shaft 130 and the sheet feeding roller 104 and the sheet feeding roller 105 simultaneously start rotating counterclockwise as shown in FIG. 2 (step S2).

At this moment, even though the rotational force of the motor 120 transmits to a separation roller 106 via a torque limiter 107, since due to the operation of the electro-magnetic clutch 124, the rotational force of the motor 120 directly transmits to the sheet feeding roller 105 as it is, the rotational force of the sheet feeding roller 105 is greater than that of the separation roller 106, and the separation roller 106 which is pressed to the sheet feeding roller 105 rotates following to the rotation of the sheet feeding roller 105.

When the sheet feeding roller 104 starts rotating, sheet PA placed on the top of the sheet-feeding tray 40 is sent to contacting portion of the sheet feeding roller 105 and the separation roller 106 from the sheet-feeding tray 40. Sheet PA is conveyed to a conveyance roller 108 side while being sandwiched by the sheet feeding roller 105 and the separation roller 106.

After that, the controller 151 determines whether a second sensor 114 detects a sheet PA or not (step S3). When the second sensor 114 does not detect a sheet PA (step S3: No), the operation of step S3 repeats until the second sensor 114 detects a sheet PA. When the second sensor 114 detects the leading edge of sheet PA (step S3: Yes), the controller 151 determines whether the temperature measured by a temperature sensor TS is not less than first predetermined temperature T1 (step. S4).

When temperature is not less than first predetermined temperature T1 (step S4: YES), the rotational force of the motor 120 is transmitted to the shaft 131 via a transmission gear 122, gears 132, 133 and a clutch gear 138 by the operation of an electro-magnetic clutch 137 for connecting the shaft 131 to electro-magnetic clutch 137. Consequently, the shaft 131 starts rotating. Then the rotational force is transmitted to the separation roller 106 from a gear 139 via gears 134, 135 and 136. The rotational force is applied to the separation roller 106 so that the separation roller 106 conveys sheets PA in a reverse direction against the sheet feeding direction of the sheet feeding roller 105 (step S5).

Before the electro-magnetic clutch 137 starts operation, the rotational force of the shaft 130 is transmitted to the separation roller 106 via the torque limiter 107. Once the electro-magnetic clutch 137 starts operating in the operation of step S5, the separation roller 106 is forcefully driven by a forced reverse transmission mechanism 116C. Accordingly, the sheet feeding roller 105 and the separation roller 106 act against sheet PA with conveyance forces being reverse directions each other in the operation of step S5.

In this situation described above, when a single sheet of sheets PA is fed from the sheet-feeding tray 40, since the outer periphery of the sheet feeding roller 105 is structured by a material having a larger friction coefficient than that of the separation roller 106, the separation roller 106 rotates as the separation roller 106 slips on the lower surface of the sheet while the sheet feeding roller 105 continue to convey the sheet to the side of the conveyance roller 108. When plural sheets PA being overlapped are sent out from the sheet feeding tray 40, the sheet feeding roller 105 continues rotating counter-clockwise to convey the sheet of sheets PA positioned on the top of sheets PA to a conveyance roller 108 side as shown in FIG. 2. The separation roller 106 continues rotating counter-clockwise as shown in FIG. 2, and to convey the sheets positioned in the lower side of sheet PA to the sheet feeding tray 40 while being in touch with overlapped sheets PA. Namely, when the electro-magnetic clutch 137 operates in the operation of step S5 and overlapped plural sheets PA are fed out from the sheet feeding tray 40, a sheet positioned on the top of the plural sheets PA is sent out to the conveyance roller 108 side. The other sheets PA are separated from the sheet positioned on the top and returned to the sheet feeding 40 side.

In the operation of step S5, the electro-magnetic clutch 137 continues operating for a fourth predetermined time interval and the operation of the electro-magnetic clutch 137 stops when the fourth predetermined time interval has passed (step. S6). Then, the connection between the shaft 131 and the electro-magnetic clutch 137 is released. As a result, a clutch gear 138 freewheels and the transmission of rotational force from the shaft 131 to the separation roller 106 is intercepted. Namely, it comes to a state that the rotational force being transmitted through the torque limiter 107 to the shaft 130 is transmitted to the separation roller 106.

As described above, paper feeding is conducted while forcefully driving the separation roller 106 in the reverse direction being against to the paper feeding direction when temperature is not less than the first predetermined temperature T1.

At high temperature, there is a tendency that the separation of overlapped sheets becomes difficult. However, the separation at high temperature, namely, double feed can be well prevented by forcefully driving the separation roller 106 as described above. For example, the first predetermined temperature T1 is set at 29° C. and the fourth predetermined time interval is, for example, set at 100 msec.

After that, the controller 151 starts measuring time at step S31, and determines whether elapsed time reaches to the second predetermined time interval (step S32). When determined that the elapsed time has not reached to the second predetermined time interval (step S32: NO), the process of step S32 will be repeated until the elapsed time of step S31 reaches to the predetermined time interval.

When the controller 151 determines that the elapsed time has reached to the second predetermine time interval from the moment when starts measuring time in step S31 (step S32: YES), the operation of the electro-magnetic clutch 124 is stopped (step S33). Then the connection between the shaft 123 and the electro-magnetic clutch 124 is released and the clutch gear 125 freewheels. Accordingly, rotational force from the transmission gear 122 to the sheet feeding roller 104 and the sheet feeding roller 105 is intercepted.

After that, the controller 151 determines whether a signal for directing the restart of feeding sheet PA is inputted (step S34). When determined that the directing signal has not inputted (step S34: NO), the controller 151 repeats the process of step 34 until the signal for directing the restart of feeding sheet PA is inputted. When the controller 151 determines that the signal for directing the restart of feeding sheet PA has inputted (step S34: YES), the electro-magnetic clutch 141 operates to rotate the conveyance roller 108 counter-clockwise as shown in FIG. 2 (step S36).

After that, the controller 151 determines whether the third sensor 115 detects the sheet PA or not. When the third sensor 115 does not detect the sheet PA (step S37: No), the operation of step S37 is repeated until the third sensor 115 detects the leading edge of sheet PA. When the third sensor 115 detects the leading edge of sheet PA (step S37: YES), the controller 151 determines whether the third sensor 115 detects the sheet PA or not, again (step S38). The operation of step 38 is repeated while the third sensor 115 is detecting sheet PA (step S38: NO).

When the third sensor 115 comes to a condition that the third sensor does not detect sheet. PA (step S38: YES), namely, the rear edge of sheet PA has passed through a portion where the third sensor 115 detects sheet PA, the operation of the electro-magnetic clutches 140 and 141 stop (step S39). Then, the connection between the shaft 130 and the electro-magnetic clutch 140 is released and the clutch gear 132 freewheels. As a result, the transmission of rotational force from the transmission gear 119 to the separation roller 106 is shut off. Simultaneously, the rotational force from the motor 120 to the conveyance roller 108 is also shut off.

After that, the controller 151 determines whether there is a signal for directing the feed of next sheet PA (step S40). When the signal for directing the next feed of sheet PA has been inputted (step S40: YES), abovementioned operations of steps 22-39 repeat. When no signal for direction the feed of next sheet PA has been inputted (step S40: NO), the rotation of the motor 120 stops (step S41) and the operations of the feeding apparatus 100 complete.

In the determination of step S4, when temperature T detected by the temperature sensor TS is lower than the first predetermined temperature T1, the controller 151 determines whether the detected temperature is less than the second predetermined temperature T2.

When the detected temperature is less than the second predetermined temperature T2 (step S70: YES), the controller 151 changes the first predetermined time interval to a shorter time interval (step S71). When the detected temperature is not less than the second predetermined temperature (step S70: NO), the controller 151 does not change the first predetermined time interval while setting the first predetermined time interval as a standard setting time interval.

After that, the controller 151 determines whether the time interval from the moment when the second sensor 114 detects the leading edge of sheet PA in the operation of step 23 to the moment when the first sensor 113 detects the leading edge of sheet PA falls with the first predetermined time (step 25). However, in the case of an apparatus in which the sheet feeding roller 104 or the sheet feeding roller 105 etc., are arranged to be stopped when the second sensor 114 detects the leading edge of sheet PA, the controller 151 determines whether the time interval from the moment when restarting the rotation of the feeding roller 104 and the feeding roller 105, to the moment when the first sensor 113 detects the leading edge of sheet PA, falls within the first predetermined time interval.

When the detected time interval by the first sensor 113 is equal to or less than the first predetermined time interval, the controller 151 starts measuring time interval (step S31). The controller 151 determines whether the time interval from the moment when starts measuring the time interval reaches to the second predetermined time interval (step S32). When the time interval has not reached to the second predetermined time interval (step S32: NO), the controller 151 repeats the process of step S32 until the time interval reaches to the predetermined time.

When the controller 151 determines that the time interval has reached to the second predetermine time from the moment when starts measuring time interval in step S31 (step S32: YES), the operation of the electro-magnetic clutch 124 is stopped (step S33). Then the connection between the shaft 123 and the electro-magnetic clutch 124 is released and the clutch gear 125 freewheels. Accordingly, rotational force from the transmission gear 122 to the sheet feeding roller 104 and the sheet feeding roller 105 is intercepted.

After that, the controller 151 determines whether signal for directing the restart of feeding sheet PA has been inputted (step S34). When determined that the directing signal has not inputted (step S34: NO), the controller 151 repeats the process of step 34 until the signal for directing the restart of feeding sheet PA is inputted. When the controller 151 determines that the signal for directing the restart of feeding sheet PA has inputted (step S34: YES), the electro-magnetic clutch 141 operates to rotate the conveyance roller 108 counter-clockwise as shown in FIG. 2 (step S36).

On the contrary, when the time interval from the moment when the second sensor 114 detects the leading edge of sheet PA to the moment when the first sensor 113 detects the leading edge of sheet PA does not fall within the first predetermined time (step S25: NO), namely, the first sensor 113 does not detects the leading edge after the first predetermined has passed, the controller 151 stops operation of the electro-magnetic clutch 140 (step S27). Then the connection between the shaft 130 and the electro-magnetic clutch 140 is released and the clutch gear 132 freewheels. As a result, rotational force from the transmission gear 119 to the separation roller 106 is intercepted.

In this situation, since the sheet feeding roller 105 continues rotating even though the separation roller 106 stops rotating, sheet PA fed out from the sheet-feeding tray 40 is conveyed by the action of the sheet feeding roller 105 to the conveyance roller 108 side, whichever the number of sheet PA is a single sheet or plural sheets.

After that, the controller 151 determines whether the time interval from the moment when the second sensor 114 detects the leading edge of sheet PA in step S25 to the moment when the first sensor 113 detects the leading edge of sheet PA is equal to or less than third predetermined time interval being an erroneous time interval (step S28). Here, the erroneous time interval is a parameter for determining whether conveyance error of sheet PA occurs and the third erroneous time is set longer than the first predetermined time. The value of the third erroneous time interval is stored in the non-volatile memory in the control device 150 the same as the first predetermined time.

When the time interval from the moment when the second sensor 114 detects the leading edge of sheet PA in step S23 to the moment when the first sensor 113 detects the leading edge of sheet PA is equal to or less than the third predetermined time (step 28: YES), namely, the first sensor detects the leading edge of sheet PA within the third predetermined time, the electro-magnetic clutch 140 restarts operation so that the rotational force transmits to the separation roller 106 to convey sheet PA in the direction being reverse direction against the paper feeding direction of the feeding roller 105 (step S29).

In this situation, when a single sheet of sheet PA is fed from the sheet-feeding tray 40, the sheet feeding roller 105 continues rotating to convey the sheet PA to the conveyance roller 108 side the same as the situation after the operation of step 24, and the separation roller 106 rotates following to the rotation of the sheet feeding roller 105. When plural sheets of sheet PA are fed out from the sheet-feeding tray 40, the sheet feeding roller 105 continues rotating to convey a single sheet of sheet PA positioned on the top of the plural sheets to the conveyance roller 108 side, and the separation roller 106 returns overlapped sheets positioned lower side of the plural sheets PA to the sheet-feeding tray 40 side.

When the elapsed time from the moment when the second sensor 114 detects the leading edge of sheet PA to the moment when the first sensor 113 detects the leading edge of sheet PA does not fall within the first predetermined time interval (step S28: NO), namely, In the case of that the first sensor 113 does not detects the leading edge of the sheet PA when the first predetermined time interval has passed, the controller 151 conducts process of sending information of conveyance failure of sheet PA (step S30). In this embodiment, mechanical operations of each component of the sheet feeding apparatus 100 stop. However, a display (not shown) provided in the sheet feeding apparatus 100 may display the message and a buzzer (not shown) provided in the sheet feeding apparatus 100 may automatically sound. Still, in step S28, the controller 151 determines whether the time interval from the moment when the second sensor 114 detects the leading edge of sheet PA to the moment when the first sensor detects the leading edge of sheet PA falls within the third predetermined time interval. However, in the case of an apparatus in which the sheet feeding roller 104 or the sheet feeding roller 105 etc., are arranged to be stopped when the second sensor 114 detects, the controller 151 determines whether the time interval from the moment when restarting the rotation of the feeding roller 104 and the feeding roller 105 to the moment when the first sensor 113 detects the leading edge of sheet PA, falls within the third predetermined time interval.

After the operation of step S29, operations of steps S31 through step S36 are conducted. When the conveyance roller 108 rotates based on the operation of step S36, the leading edge of sheet PA passed through the pressing portion of the sheet roller 105 and the separation roller 106 is sandwiched between the conveyance roller 108 and the following roller 109. The sheet PA is conveyed to the outside of the sheet feeding apparatus 100 through the pressing portion between the conveyance roller 108 and the following roller 109 in accordance with the rotation of the conveyance roller 108.

After that, the controller 151 determines whether the third sensor 115 detects the sheet PA (step S37). When third sensor 115 does not detect sheet PA (step S37: NO), the operation of step S37 repeats until the third sensor 115 detects sheet PA. When the third sensor 115 detects the leading edge of sheet PA (step S37: YES), the controller 151 determines whether the third sensor 115 detects the sheet PA or not, again (step S38). The operation of step 38 repeats while the third sensor 115 is detecting the sheet PA (step 38: NO).

When the third sensor 115 becomes not to detect the sheet PA (step S38: YES), namely the rear edge of sheet PA has passed through the detecting portion of the sheet PA by the third sensor 115, the operations of two electro-magnetic clutches 140 and 141 stop (step S39). Then the connection of the shaft 130 and the electro-magnetic clutch 140 is released and the clutch gear 132 freewheels. As a result the transmission of rotational force from the transmission gear 119 to the separation roller 106 is intercepted.

After that, the controller 151 determines whether there is a signal directing for feeding sheet PA (step S40). When the signal for directing for feeding sheet PA is input (step S40: YES), the operations of each task of steps S22-S39 repeats. When the signal for directing for feeding sheet PA has not been inputted (step S40: NO), rotation of the motor 120 stops (step S41) and the feeding operation of sheet feeding apparatus 100 finishes.

In the processes from step S27 to step S29, the sheets are conveyed while the reverse action of the separation roller 106 is released. Accordingly, no-feed can be well prevented.

The change of the first predetermined time interval at steps S70 and S71 is conducted to execute the processes of steps S27-S29 at low temperature in an early stage based on the determination whether the controller 151 executes the processes of steps S27-S29 and the timing of. Accordingly, no-feed can be prevented.

The second predetermined temperature for applying the determination of step 70 is set, for example, at 19° C. In step S71, the standard first predetermined time interval is set at, for example, 85 msec, and the first predetermined time interval will be change to, for example, 80 msec when temperature is low. In accordance with the embodiments of the invention, since the double feed in which the separability of overlapped sheets lowers at high temperature can be well prevented and no-feed caused by the characteristic that a conveyance roller and a sheet tend to slip each other at low temperature can be well prevented, high speed paper feed and conveyance become to be stably conducted.

What is claimed is:

1. A feeding apparatus comprising:

a feeding roller for feeding a sheet in a sheet feeding direction;

a separation roller for conveying the sheet in a reverse direction against the sheet feeding direction based on a rotational force transmitted through a torque limiter, the separation roller being opposed to the feeding roller;

a transmission mechanism for transmitting the rotational force to the feeding roller;

a first sensor for detecting existence of the sheet, the first sensor being arranged downstream against the feeding roller in a sheet conveyance direction;

a temperature detector for detecting ambient temperature; and a controller which determines a first predetermined time interval, which is a time interval from a reference time set after starting feeding the sheet with the feeding roller to a moment when the first predetermined time interval has elapsed, based on detected information from the temperature detector, wherein the controller temporarily stops transmitting the rotational force to the separation roller so that the separation roller rotates in the sheet feeding direction driven by a rotation of the feeding roller in case the first sensor does not detect the sheet within the first predetermined time interval, and re-transmits the rotational force to the separation roller.

2. The feeding apparatus of claim 1, wherein the controller stops feeding the sheet in case the first sensor does not detect the sheet within a second predetermined time interval after the controller temporarily stops transmitting the rotational force to the separation roller.

3. The feeding apparatus of claim 1, further comprising:

a second sensor for detecting the existence of the sheet, the second sensor being arranged upstream against the first sensor in the sheet conveyance direction, wherein the reference time set after starting feeding the sheet is a moment when the second sensor detects a leading edge of the sheet.

4. The feeding apparatus of claim 3, wherein the controller stops feeding the sheet when the first sensor does not detect the sheet within a second predetermined time interval from the moment when the second sensor detects the sheet.

5. The feeding apparatus of claim 1, wherein the feeding roller has a friction coefficient, which is larger than a friction coefficient of the separation roller.

6. The feeding apparatus of claim 1, wherein the feeding roller and the separation roller have respective outer peripheries, which are structured by rubber and an outer periphery of the separation roller is harder than that of the feeding roller.

7. An image forming apparatus comprising:

a feeding roller for feeding a sheet in a sheet feeding direction;

a separation roller for conveying the sheet in a reverse direction against the sheet feeding direction based on a rotational force transmitted through a torque limiter, the separation roller being opposed to the feeding roller;

a transmission mechanism for transmitting the rotational force to the feeding roller;

a first sensor for detecting existence of the sheet, the first sensor being arranged downstream against the feeding roller in a sheet conveyance direction;

a temperature detector for detecting ambient temperature; and a controller which determines a first predetermined time interval, which is a time interval from a reference time set after starting feeding the sheet with the feeding roller to a moment when the first predetermined time interval has elapsed, based on detected information from the temperature detector, wherein the controller temporarily stops transmitting the rotational force to the separation roller so that the separation roller rotates in the sheet feeding direction driven by a rotation of the feeding roller in case the first sensor does not detect the sheet within the first predetermined time interval, and re-transmits the rotational force to the separation roller.

8. A feeding apparatus comprising:

a feeding roller for feeding a sheet in a sheet feeding direction;

a separation roller for conveying the sheet in a reverse direction against the sheet feeding direction based on a rotational force transmitted through a torque limiter, the separation roller being opposed to the feeding roller;

a transmission mechanism for transmitting the rotational force to the feeding roller;

a first sensor for detecting existence of the sheet, the first sensor being arranged downstream against the feeding roller in a sheet conveyance direction;

a temperature detector for detecting ambient temperature; and a controller which determines a first predetermined time interval, which is a time interval from a reference time set after starting feeding the sheet with the feeding roller to a moment when the first predetermined time interval has elapsed, based on detected information from the temperature detector, wherein the controller temporarily stops transmitting the rotational force to the separation roller and the separation roller rotates in the sheet feeding direction driven by the feeding roller in case the first sensor does not detect the sheet within the first predetermined time interval, and re-transmits the rotational force to the separation roller.

9. An image forming apparatus comprising:

a feeding roller for feeding a sheet in a sheet feeding direction;

a separation roller for conveying the sheet in a reverse direction against the sheet feeding direction based on a rotational force transmitted through a torque limiter, the separation roller being opposed to the feeding roller;

a transmission mechanism for transmitting the rotational force to the feeding roller;

a first sensor for detecting existence of the sheet, the first sensor being arranged downstream against the feeding roller in a sheet conveyance direction;

a temperature detector for detecting ambient temperature; and a controller which determines a first predetermined time interval, which is a time interval from a reference time set after starting feeding the sheet with the feeding roller to a moment when the first predetermined time interval has elapsed, based on detected information from the temperature detector, wherein the controller temporarily stops transmitting the rotational force to the separation roller so that the separation roller rotates in the sheet feeding direction driven by the feeding roller in case the first sensor does not detect the sheet within the first predetermined time interval, and re-transmits the rotational force to the separation roller.

* * * * *